US012163335B1

(12) United States Patent
Fischer

(10) Patent No.: US 12,163,335 B1
(45) Date of Patent: Dec. 10, 2024

(54) DRAINAGE JUNCTION SHIELD

(71) Applicant: John G. Fischer, Irving, TX (US)

(72) Inventor: John G. Fischer, Irving, TX (US)

( * ) Notice: Subject to any disclaimer, the term of this patent is extended or adjusted under 35 U.S.C. 154(b) by 0 days.

(21) Appl. No.: 18/642,772

(22) Filed: Apr. 22, 2024

Related U.S. Application Data

(60) Provisional application No. 63/461,137, filed on Apr. 21, 2023.

(51) Int. Cl.
*E04D 13/08* (2006.01)

(52) U.S. Cl.
CPC ..... *E04D 13/08* (2013.01); *E04D 2013/0806* (2013.01); *Y10T 137/7043* (2015.04)

(58) Field of Classification Search
CPC ..... E04D 13/08; E04D 2013/0806; E04D 2013/084; E04D 2013/0886; E04D 2013/0893; Y10T 137/7043
See application file for complete search history.

(56) References Cited

U.S. PATENT DOCUMENTS

| | | | | |
|---|---|---|---|---|
| 3,048,983 | A * | 8/1962 | Crummel | E04D 13/08 404/2 |
| 3,465,885 | A * | 9/1969 | Trump | E04D 13/08 210/447 |
| 5,584,147 | A * | 12/1996 | Agee | E04D 13/10 52/302.1 |
| 8,656,947 | B1 * | 2/2014 | Barton | E04D 13/08 210/170.03 |
| 9,297,154 | B2 * | 3/2016 | deLoache, III | E03D 1/012 |
| 9,399,849 | B2 * | 7/2016 | Langenderfer | E02D 27/50 |
| 9,469,976 | B1 * | 10/2016 | Banks | F24H 8/006 |

* cited by examiner

*Primary Examiner* — Kevin F Murphy

(57) ABSTRACT

A drainage junction shield is disclosed that provides protection for the lower portion of a storm water downspout and its intersection with an adapter and drainpipe. Protection is provided against string trimmers and edgers and other impacting implements in a landscape environment. A shielded adapter chamber has perimeter flanges for pinning to a soil surface. The adapter chamber encloses the intersection of the drainpipe, adapter, and downspout as against a wall. A shielded downspout chamber extends above the adapter chamber and converges to an extension access that receives and encloses the lower end of a downspout.

27 Claims, 23 Drawing Sheets

DRAINAGE JUNCTION SHIELD

CROSS-REFERENCES TO RELATED APPLICATIONS

This application claims priority to Provisional Application No. 63/461,137 filed Apr. 21, 2023.

BACKGROUND

Technical Field

The present disclosure provides protection to downspouts and junctions connected to roof gutter systems used for capture and control of roof diverted storm water.

Background Information

Residential and commercial buildings utilize a variety of gutter and downspout systems for collection of water and control of storm water flow. Failing to properly control storm water impacting the roof of a residential or commercial building can have a critically negative effect on the stability of the foundation supporting the residence or building.

During a storm, an effective gutter system will channel water flow from the roof, through downspouts for redirection to appropriate areas away from the home or building. Without an effective gutter system, storm water may pool non-uniformly around the building and destabilize the soil and therefore the foundation.

Gutter systems are critical where the ground slopes towards the building or home. In addition to maintaining a uniform moisture of the soil around a building's foundation, a good gutter system will prevent water stains on walls.

A residence or building without gutters also results in uneven flow of water from the roof to areas of normal human or vehicle access. Controlling the distribution of storm water also permits collection and reuse of the storm water.

Additionally, roof water that is not collected in a gutter system may drip and coalesce onto the soffit portion of the building, soaking it to the point of the development of mold and premature decay.

A functioning gutter system will do more than protect the residential or commercial building. The gutter system will also preserve the landscaping. Without properly functioning gutters and downspouts to control runoff, storm water will cut pathways through yards and neighboring yards, creating ditches, killing lawns, flowers and vegetation, and pooling in low lying areas, killing lawns and rotting and destabilizing fences, and destabilizing driveways and sidewalks.

When it rains, storm water flows down the slope of the roof to the gutters. As the water begins to pool, it travels through the gutter system to the downspout. Downspouts carry water from the gutters to the base of the house or building. At the base of the house or building, the storm water is diverted to protect basements and foundations from flooding and further water damage.

Gutter systems are believed to have been known since 1500 BC. During the Norman Empire's rule between the 10th and 13th centuries, gutter systems were integrated into the architecture of buildings. Many of these structures included roofs with parapets and gargoyles that allowed the water to flow out of the mouth of the gargoyle.

During the reign of Henry VIII, gutters were popularized in England and made from lead, much of which had been confiscated from the church. Cast iron gutters became popular in the 1700s. When the Industrial Revolution began, gutters started being mass produced. Gutters were also made from wood in a V shape and attached to buildings and homes. These gutters were often lined with zinc.

In the 1900s, gutters were made of steel which became popular due to its resistance to rot. The advent of the Second World War and the shortage of steel gave rise to the use of aluminum as the most common gutter material because of its lightweight and excellent strength. Also, during the 1900s, manufacturers began developing plastic materials for use in association with water systems including sprinkler systems and gutters. The 1960s saw the introduction of seamless gutters which became the standard by the 1980s.

Around the same time (1970s), George Ballas of Houston, TX, invented the Weed Eater® which was soon followed by competing models known generically as string trimmers. Early models were frustrating to use, but development continued and within the next two decades, string trimmers became a stable of lawn service.

String trimmer technology was favored in part for safety reasons to replace the rotating steel blade of an edger. The string trimmer could be operated close to the base of the house without sending sparks or chipping concrete or chipping the blade and risking injury to the operator.

The confluence of the development and popularization of string trimmers, with the half century old technology of aluminum gutters and downspouts and plastic and PVC draining technology, has led to the need for the present invention.

As has been seen most clearly over the past two decades, string trimmers are not as dangerous as the rotating steel blade of an edger, but they are persistent and effective in eventually wearing materials down, especially objects made of plastic, aluminum, or wood. Millions of fences, mailboxes, and rain gutters have met a torturous and slow destruction by the weekly beating of a string trimmer. Though more resistant to degradation than wood, aluminum downspouts and their PVC drainage connectors are not compatible with string trimmers.

A first disadvantage is that aluminum downspouts and PVC connectors are geometrically dissimilar and aesthetically displeasing. The most common gutter styles used on residential homes are K-style and half round gutters. A standard gutter size is five inches. The most common seamless gutter downspouts are two and one-half inches by three inches and three inches by four inches. The downspouts commonly require connection to an underground drain. The underground drains may also be different sizes including most commonly four-inch and five-inch diameters. Since downspouts are most commonly rectangular, and drainage pipes inevitably cylindrical, a PVC downspout adapter is required to allow water to flow from the downspout into the drainage pipe.

A primary disadvantage of the conventional residence and commercial building drainage technology is that aluminum downspouts are highly susceptible to damage by string trimmers, leaving them aesthetically offensive and potentially inoperable. PVC downspout adapters are also susceptible to damage. Damage to both normally requires the services of separate contractors to remove and replace the adapter and downspout.

A second disadvantage of the current state of roof drainage technology is that drainage systems normally require PVC downspout adapters between rectilinear aluminum downspouts to cylindrical drainpipes. The downspout adapters themselves are transitions having two components of geometry that are dissimilar in appearance to the rectilinear aluminum downspout that is most commonly used.

Another disadvantage of the current state of technology is that the downspout adapters are normally located at ground level, but are inevitably unevenly located above the ground, often varying randomly from semi-subsurface to flush to the ground to noticeably above the ground atop a cylindrical drainpipe.

Even when located near to the ground, there is most often a difference in the height of the downspout adapter's mounting as viewed from the curb of a residence or commercial building. This provides a very uneven appearance and degrades the curb appeal of the residence or building.

There is a need for a solution to this problem that is aesthetically pleasing, universally applicable to the union of the rectangular downspout and odd shaped downspout adapters, and wear resistant to the abuse of string trimmers by commercial gardeners.

SUMMARY

As used herein, the terms "substantial" and "substantially" mean mostly.

An advantage of the disclosed embodiments is that they provide a means and device that solves the above-described problems with conventional intersections of thin metal and plastic downspouts with PVC downspout adapters.

A particular advantage of the disclosed embodiments is that they provide a device that protects both downspouts and downspout adapters from damage by engagement from string trimmers.

Another advantage of the disclosed embodiments is that they provide a device that is adaptable to existing conventional intersections of downspouts and PVC downspout adapters, with allowance for a range of heights of installation of adapters.

Another advantage of the disclosed embodiments is that they provide two internal chambers, including one for the larger transition adapters and a second that converges to the downspout to prevent intrusion of exterior landscape debris and animals.

Another advantage of the disclosed embodiments is that they provide a device that accommodates downspouts mounted adjacent to walls, posts, and other vertical structures.

Another advantage of the disclosed embodiments is that they provide an aesthetically pleasing geometry that covers the multiple dissimilar geometries of a conventional intersection between aluminum downspouts and PVC downspout adapters.

Another advantage of the disclosed embodiments is that they provide an aesthetically pleasing surface material that covers the multiple dissimilar materials of a conventional intersection between aluminum downspouts and PVC downspout adapters.

Another advantage of the disclosed embodiments is that they provide an aesthetically pleasing color that covers the multiple dissimilar colors of a conventional intersection between aluminum downspouts and PVC downspout adapters.

Another advantage of the disclosed embodiments is that the device accommodates the multiple dissimilar height positions of conventional intersections between aluminum downspouts and PVC downspout adapters with the surface soil.

Another advantage of the disclosed embodiments is that by providing an improved and uniform appearance at the base of multiple downspouts, they enhance the curb appeal of the property.

Another advantage of the disclosed embodiments is that they provide a variable means for securing the device to the soil, allowing avoidance of interference with subsurface drainpipes regardless of the direction of the drainpipes.

Another advantage of the disclosed embodiments is that they provide an alternative device of uniform physical appearance when a downspout fails to connect to a drainpipe, but rather extends away from the vertical structure from which water is drained.

Another advantage of the disclosed embodiments is that they provide a manufacturing means that is efficient and cost effective.

Another advantage of the disclosed embodiments is that they provide a device having a much-improved aesthetic appeal that can be further enhanced with the addition of a desired design on its exterior surfaces.

In one embodiment, a drainage junction shield has a base comprising a base right, a base front, and a base left. A base access spans between the ends of the base left and the base right opposite to the base front. An adapter chamber is formed between the base left, base right, and base front.

An extension has an extension right extending above the base right, an extension front extending above the base front, and an extension left extending above the base left. An extension access spans between ends of the extension left and the extension right opposite to the extension front.

A downspout chamber is formed between the base left, base right, and base front. A base perimeter is formed at the intersection of the base and the extension. An entry perimeter is formed along the top of the extension opposite to the base perimeter and is shorter than the base perimeter. The drainage junction shield is impervious to deformation from engagement with a string trimmer.

In another embodiment, the extension right is inclined over the adapter chamber, towards the extension left. The extension front is inclined over the adapter chamber, towards the extension access, and the extension left is inclined over the adapter chamber, towards the extension right.

In another embodiment, flanges extend laterally outward from one or more of the base left, base right, and base front. Anchor holes are provided on the flanges. The anchor holes are receivable of soil pins for securing the drainage junction shield to a soil surface.

In another embodiment, the number of the anchor holes exceeds the number of soil pins needed to secure the drainage junction shield to the soil, such that the locations of the anchor holes provide multiple non-conflicting locations for insertion of soil pins regardless of the direction of a drainpipe beneath the soil surface.

In another embodiment, the anchor holes are positioned within a distance of 3.25 inches and 4.00 inches to a central point of a drainpipe position at the soil surface.

In another embodiment, all anchor holes are distanced within ¾ inches equally to a central point of a drainpipe position at the soil surface.

In another embodiment, the adapter chamber is of sufficient volume to receive an adapter connected to a drainpipe and a downspout.

In another embodiment, the base and adapter chamber are of sufficient height to receive an adapter connected to a drainpipe that extends partially above the soil surface.

In another embodiment, the entry perimeter is of sufficient size to receive a gutter system downspout.

In another embodiment the entry perimeter is sized to receive a gutter system downspout in sufficient proximity to limit foreign material entry into the downspout chamber.

In another embodiment, the extension forms a converging enclosure above the base for complementary fit of a downspout into the entry perimeter.

In another embodiment, the entry perimeter and extension access form a polygon of fewer sides than the base perimeter and base access.

In another embodiment, the base perimeter and base access form a rectangle and the entry perimeter and extension access form a rectangle.

In another embodiment, the base perimeter and base access form a hexagon and the entry perimeter and extension access form a rectangle.

In another embodiment, a decorative element is positioned on the base and/or on the extension.

In another embodiment, the drainage junction shield is made of 14 gauge steel.

In another embodiment, a base right chamfer is formed between the base right and the base front. A base left chamfer is formed between the base left and the base front. An extension right chamfer is formed between the extension right and the extension front. An extension left chamfer is formed between the extension left and the extension front. The base perimeter has five sides and forms a hexagon when placed adjacent a wall, and the entry perimeter has three sides and forms a rectangle when placed adjacent the wall.

In another embodiment, a flange extends laterally outward from each of the base left, base left chamfer, base right, base right chamfer, and base front. A plurality of anchor holes is located on each flange. The anchor holes are receivable of soil pins for securing the drainage junction shield to a soil surface.

An alternative embodiment of the drainage junction shield is designed for compatibility with downspout that does not connect to drainpipe, but is for redirection of storm water away from a wall and onto soil surface. In this embodiment, the drainage junction shield includes a drain portal for accommodating a downspout drain.

In another embodiment, a drainage junction shield comprises a base having four sections comprising a base right, a base right chamfer, a base left chamfer, and a base left. A base access spans between the ends of the base left and the base right opposite to the base front. An adapter chamber is formed inside the base right, base right chamfer, base left chamfer, and base left. A flange extends from each of the base right, base right chamfer, base left chamfer, and base left.

An extension has four sections comprising an extension right extending above the base right, an extension right chamfer extending above the base right chamfer, an extension left chamfer extending above the base left chamfer, and an extension left extending above the base left. An extension access spans between the ends of the extension left and the extension right opposite to the extension front.

A downspout chamber is formed between the base right, base right chamfer, base left chamfer, and base left. A base perimeter is formed at the intersection of the base and the extension, and an entry perimeter is formed along the top of the extension opposite to the base perimeter. The entry perimeter is shorter than the base perimeter.

In another embodiment, a base has five sections comprising a base right, a base right chamfer, a base front, a base left chamfer, and a base left. A base access spans between the ends of the base left and the base right opposite to the base front. An adapter chamber is formed between the base right, base left, and base front. A flange extends from each of the base sections.

An extension has five sections comprising an extension right extending above the base right, an extension right chamfer extending above the base right chamfer, an extension front extending above the base front, an extension left chamfer extending above the base left chamfer, and an extension left extending above the base left. An extension access spans between the ends of the extension left and the extension right opposite to the extension front.

A downspout chamber is formed between the base left, base right, and base front. A base perimeter is formed at the intersection of the base and the extension, and an entry perimeter is formed along the top of the extension opposite to the base perimeter. The entry perimeter is shorter than the base perimeter.

In one embodiment, a method of manufacturing a drainage junction shield having three sides is disclosed, comprising the steps of providing a flat sheet metal template for the drainage junction shield, the template in a template plane; bend forming the flanges outward about 90 degrees to the template plane; bend forming the extension left and extension right inward between 5 and 20 degrees to the template plane; bend forming the extension front inward between 5 and 20 degrees to the template plane; and bend forming the base left and base right inward between 85 and 90 degrees to the template plane.

In another embodiment, a method of manufacturing the drainage junction shield having four sides is disclosed, comprising the steps of providing a flat sheet metal template for the drainage junction shield, the template in a template plane; bend forming the flanges outward about 90 degrees to the template plane; bend forming the extension left and extension right inward between 2 and 20 degrees to the template plane; bend forming the extension left front and extension right front inward between 10 and 45 degrees to the template plane; bend forming the base left chamfer and the base right chamfer inward between 37 and 41 degrees to the template plane; and bend forming the base left and base right inward between 85 and 90 degrees to the template plane.

In another embodiment, a method of manufacturing the drainage junction shield having five sides is disclosed, comprising the steps of providing a flat sheet metal template for the drainage junction shield, the template in a template plane; bend forming the flanges outward about 90 degrees to the template plane; bend forming the extension left chamfer and extension right chamfer inward between 6 and 10 degrees to the template plane; bend forming the extension left and extension right inward between 2 and 6 degrees to the template plane; bend forming the extension front inward between 20 and 24 degrees to the template plane; bend forming the base left chamfer and the base right chamfer inward between 37 and 41 degrees to the template plane; and bend forming the base left and base right inward between 85 and 90 degrees to the template plane.

In another embodiment, a drainage junction shield has a base with a base access. An adapter chamber is formed within base and base access. A flange extends outward from the base and has a plurality of anchor holes. An extension is located above the base and has an extension access in the same plane as the base access. A downspout chamber is formed within the extension and the extension access. An entry perimeter is formed at the top of the extension. The base access and extension access allow adjacent placement of the drainage junction shield over a downspout and adapter, and against a vertical wall or structure. The entry perimeter is receivable of the downspout. The anchor holes are receivable of soil pins for attachment of the drainage junction shield to a soil surface.

BRIEF DESCRIPTION OF THE DRAWINGS

The drawings constitute a part of this specification and include exemplary embodiments to the disclosed device, which may be embodied in various forms. It is to be understood that, in some instances, various aspects of the disclosed device may be shown exaggerated, enlarged or otherwise spatially modified to facilitate an understanding of the disclosed device.

DETAILED DESCRIPTION

The following description is presented to enable any person skilled in the art to make and use the disclosed device, and is provided in the context of a particular application and its requirements. Various modifications to the disclosed embodiments will be readily apparent to those skilled in the art, and the general principles defined herein may be applied to other embodiments and applications without departing from the spirit and scope of the disclosed device. Thus, the disclosed device is not intended to be limited to the embodiments shown, but is to be accorded the widest scope consistent with the principles and features disclosed herein.

FIGS. 1-4 are photographs of prior art conventional intersections of downspouts and PVC downspout adapters, all of which were photographed at a residential property. FIGS. 1-4 illustrate the significant damage caused by string trimmers to both downspouts and adapters, as well as the disparity in the extension of drainpipes as to the soil level. The photographs illustrate the disruption to the functionality of residential and commercial drainage systems as a result of string trimmer and edger damage. The photographs further illustrate the destructive impact to the aesthetic appearance of residential and commercial drainage systems as a result of string trimmer and edger damage.

Figure 1:
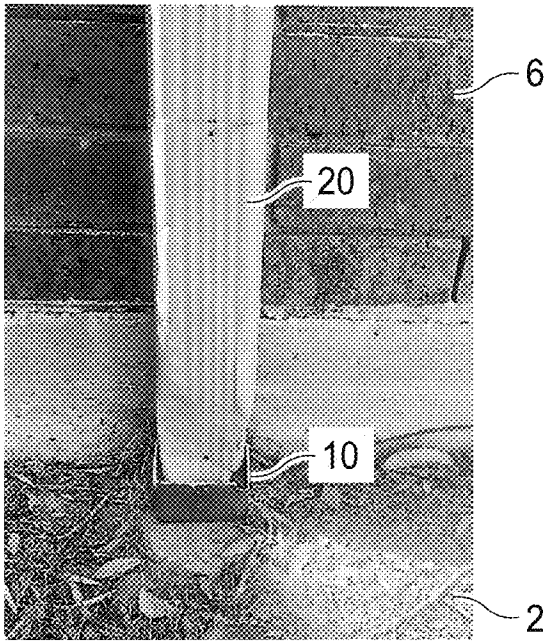
FIG. 1 Prior Art
FIG. 1 is a photograph of the prior art.

FIG. 1 illustrates a downspout 20 severely damaged by a string trimmer to the point of reducing its internal cross-sectional area and fluid carrying capacity above a downspout adapter 10. Such damage increases the probability that downspout 20 will clog with debris and cease to function as designed. FIG. 1 further illustrates damage to downspout adapter 10 caused by the use of string trimmers. The damage impairs the aesthetic value of the residence, and risks damage to the residence from a nonfunctioning gutter system.

Figure 2:
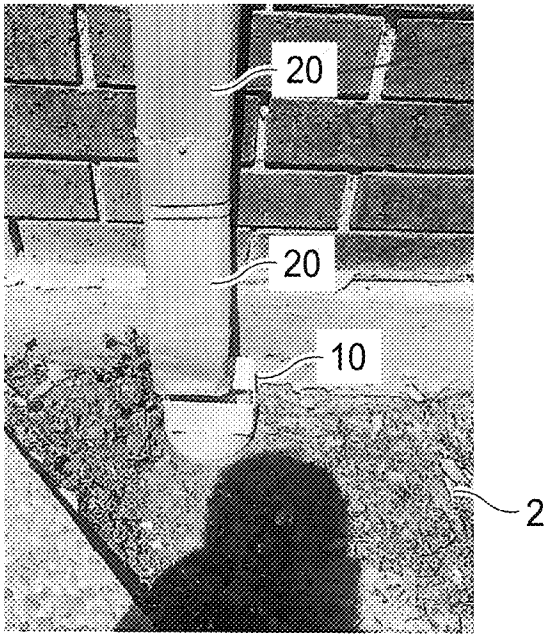
FIG. 2 Prior Art
FIG. 2 is a second photograph of the prior art.

FIG. 2 is a second photograph of the prior art. In FIG. 2, drainpipe 4 has been damaged and displaced by a string trimmer to disengage downspout 20 from adapter 10. Adapter 10 is mounted slightly above the soil line so as to be visible. Corrective realignment of either downspout 20 or adapter 10 is difficult. Surface debris may enter drainpipe 4 and drain water will flow externally of drainpipe 4. The damage impairs the aesthetic value of the residence, and risks damage to the foundation and the drainage system. An angled lower portion of downspout 20 would be a visible indicator of misalignment.

Figure 3:
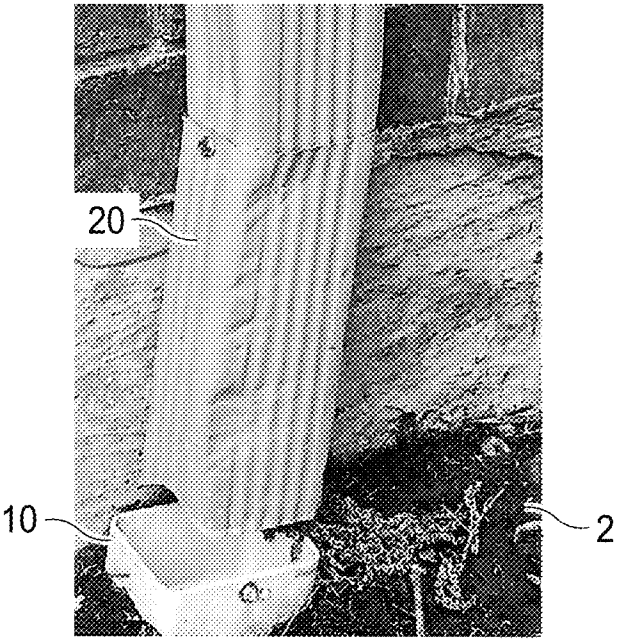
FIG. 3 Prior Art
FIG. 3 is a third photograph of the prior art.

FIG. 3 is a third photograph of the prior art. The damage to downspout 20 is clearly visible. In this example, downspout 20 has been separated from adapter 10, allowing surface debris to enter drainpipe 4 and drain water to spread externally of drainpipe 4. The damage impairs the aesthetic value of the residence, and risks damage to the foundation and the drainage system.

Figure 4:
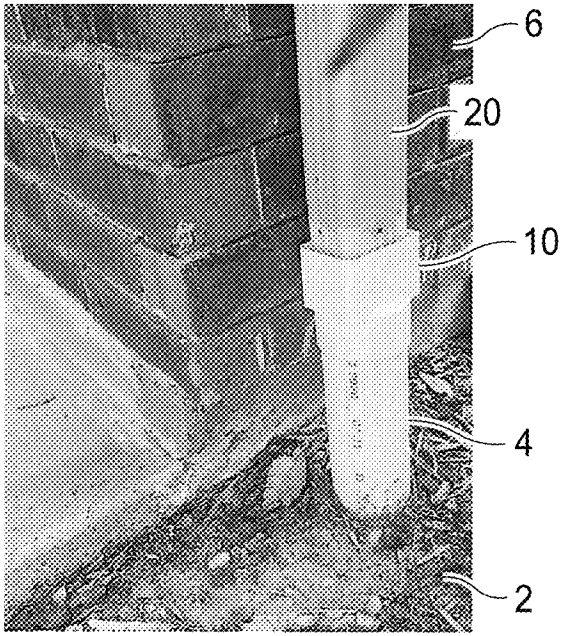
FIG. 4 Prior Art
FIG. 4 is a fourth photograph of the prior art.

FIG. 4 is a fourth photograph of the prior art. FIG. 4 illustrates the variance in height of mounting PVC downspout adapter 10 in relation to a soil surface 2. Drainpipe 4, on top of which downspout adapter 10 is mounted, extends far above soil surface 2. Downspout adapter 10 comprises a cylindrical coupling portion 12 and a rectilinear coupling portion 14 for receiving downspout 20. While the height of this drainpipe is unusually significant, variations in height of one to three inches above the surface are common.

Figure 5:
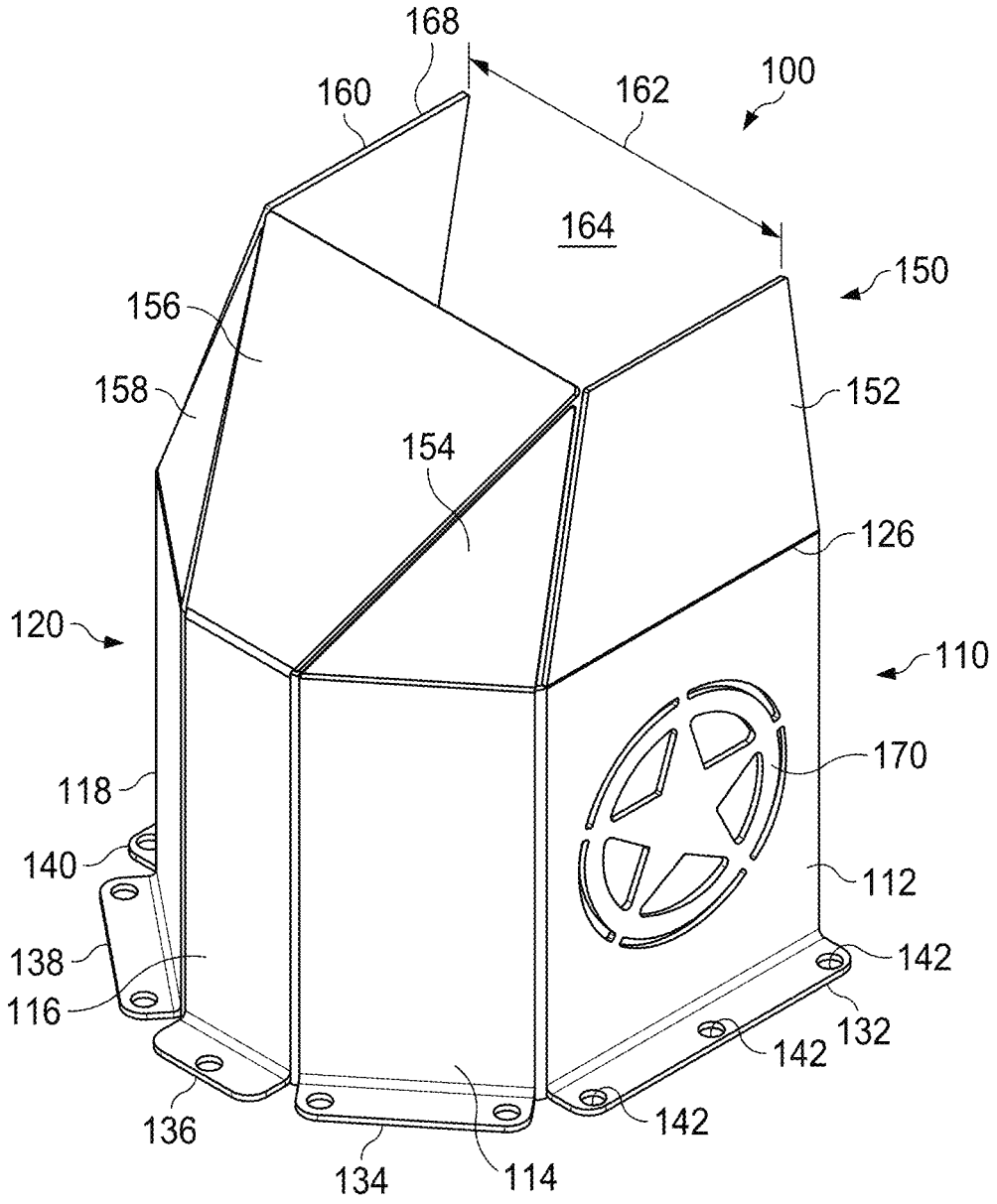
FIG. 5 is an isometric front view of an embodiment of the drainage junction shield, illustrating various elements of that embodiment.

FIG. 5 is an isometric front view of an embodiment of drainage junction shield 100, illustrating various elements of that embodiment. The embodiment illustrated has five sections. Drainage junction shield 100 has a base 110. Base 110 comprises a plurality of base sections including a base right 112, a base right chamfer 114, a base front 116, a base left chamfer 118, and a base left 120 (see FIG. 6).

Figure 11:
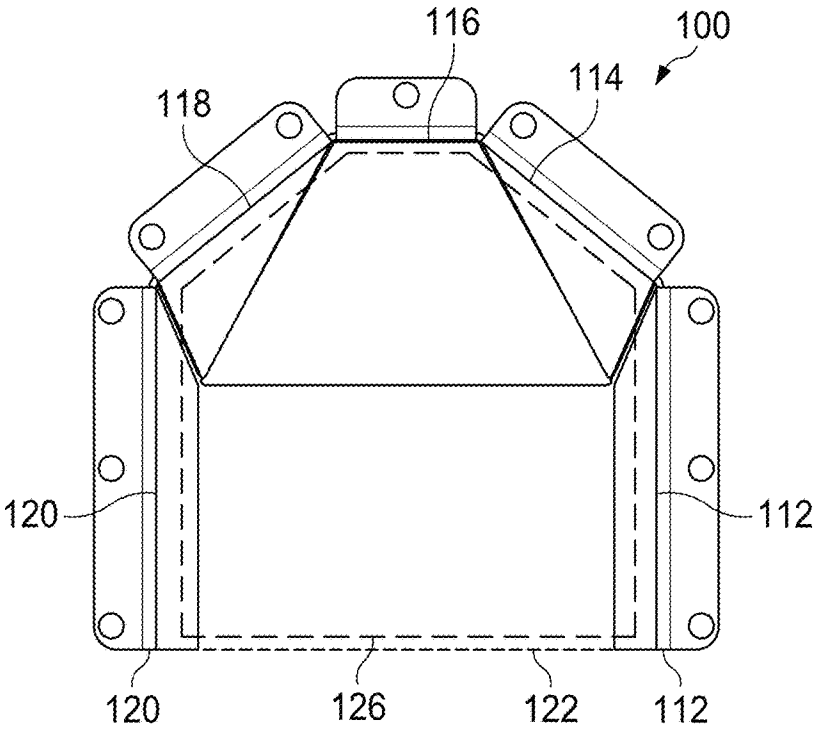
FIG. 11 is a bottom view of the embodiment of the drainage junction shield of FIG. 5.

As best seen in FIG. 11, a base access 122 is formed between a back edge of base right 112 and a back edge of base left 120. Base 100 and base access 122 form a hexagonal base perimeter 126 which defines an adapter chamber 124. Adapter chamber 124 is receivable of downspout adapter 10, which is a sewer and drain connector provided for flow enabled connection between downspout 20 and drainpipe 4.

Referring back to FIG. 5, drainage junction shield 100 has an extension 150. Extension 150 comprises a plurality of extension sections including an extension right 152, an extension right chamfer 154, an extension front 156, an extension left chamfer 158, and an extension left 160 (see FIG. 6).

As seen in FIG. 5, an extension access 162 is formed between a back edge of extension right 152 and a back edge of extension left 160. The uppermost extent of extension 150 and extension access 162 forms a rectangular entry perimeter 168. The volume between extension right 152, extension right chamfer 154, extension front 156, extension left chamfer 158, and extension left 160 defines a downspout chamber 164. Downspout chamber 164 is receivable of downspout 20 for flow enabled connection between adapter 10 and drainpipe 4.

Figure 24:
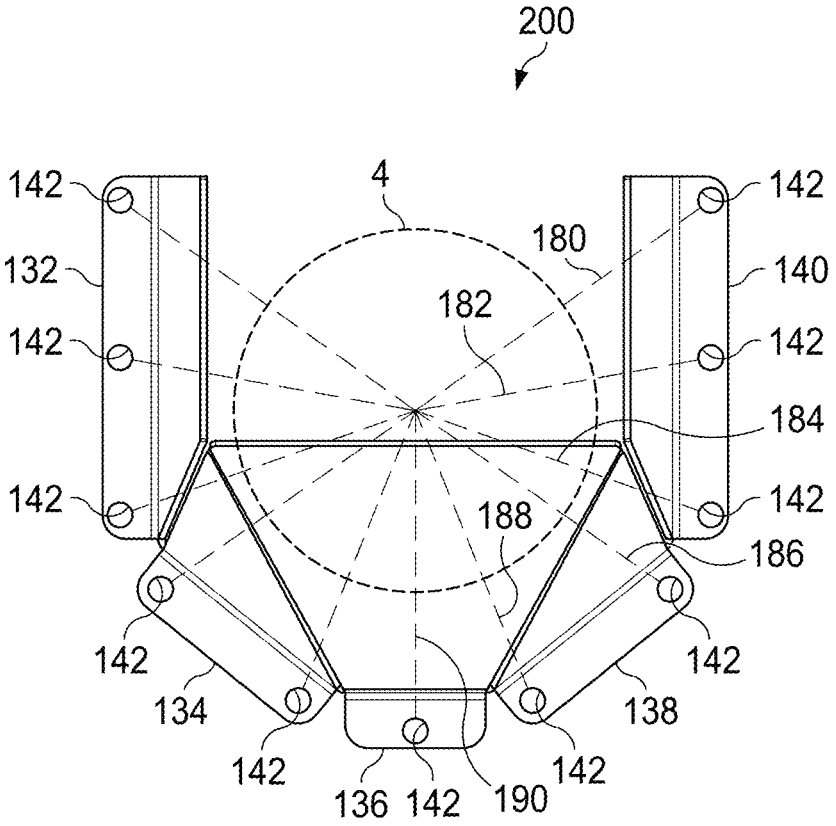
FIG. 24 is a bottom view of the embodiment illustrated in FIG. 5, illustrating the radial distances between the anchor holes and the proximate center of a drainpipe.
Figure 25:
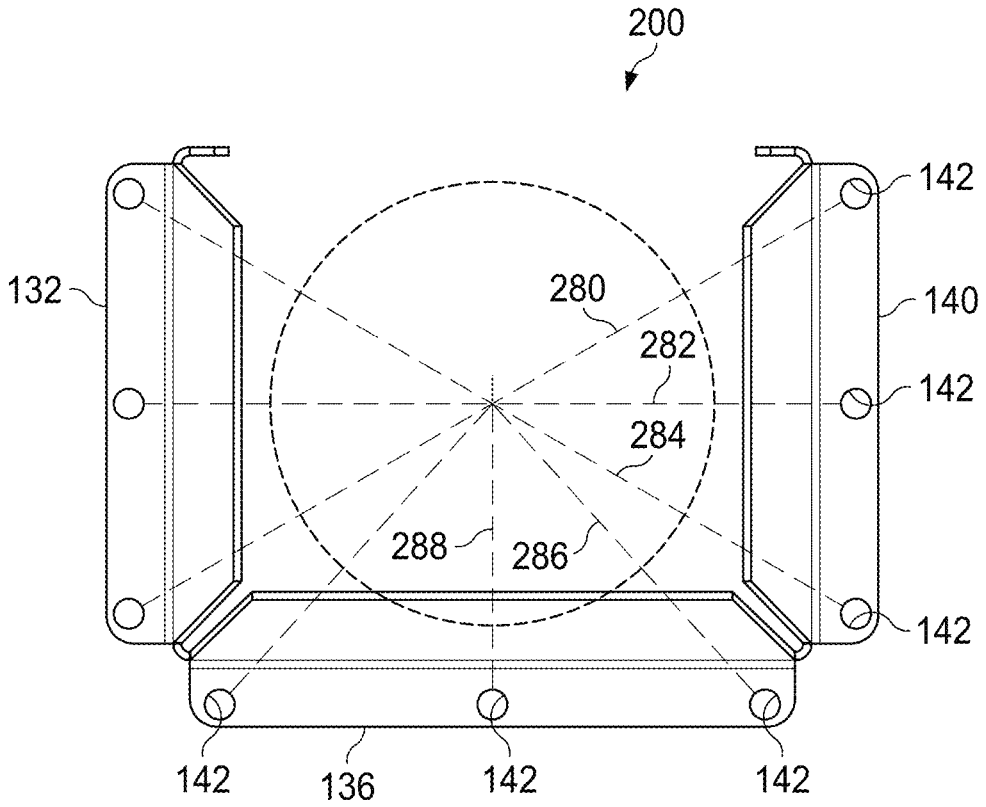
FIG. 25 is a bottom view of the embodiment illustrated in FIG. 22, illustrating the radial distances between the anchor holes and the proximate center of a drainpipe.

As seen in FIGS. 24 and 25, a flange right 132 extends perpendicularly outward from base right 112. A flange right chamfer 134 extends perpendicularly outward from base right chamfer 114. A flange front 136 extends perpendicularly outward from base front 116. A flange left chamfer 138 extends perpendicularly outward from base left chamfer 118. A flange left 140 extends perpendicularly outward from base left 120.

Figure 14:
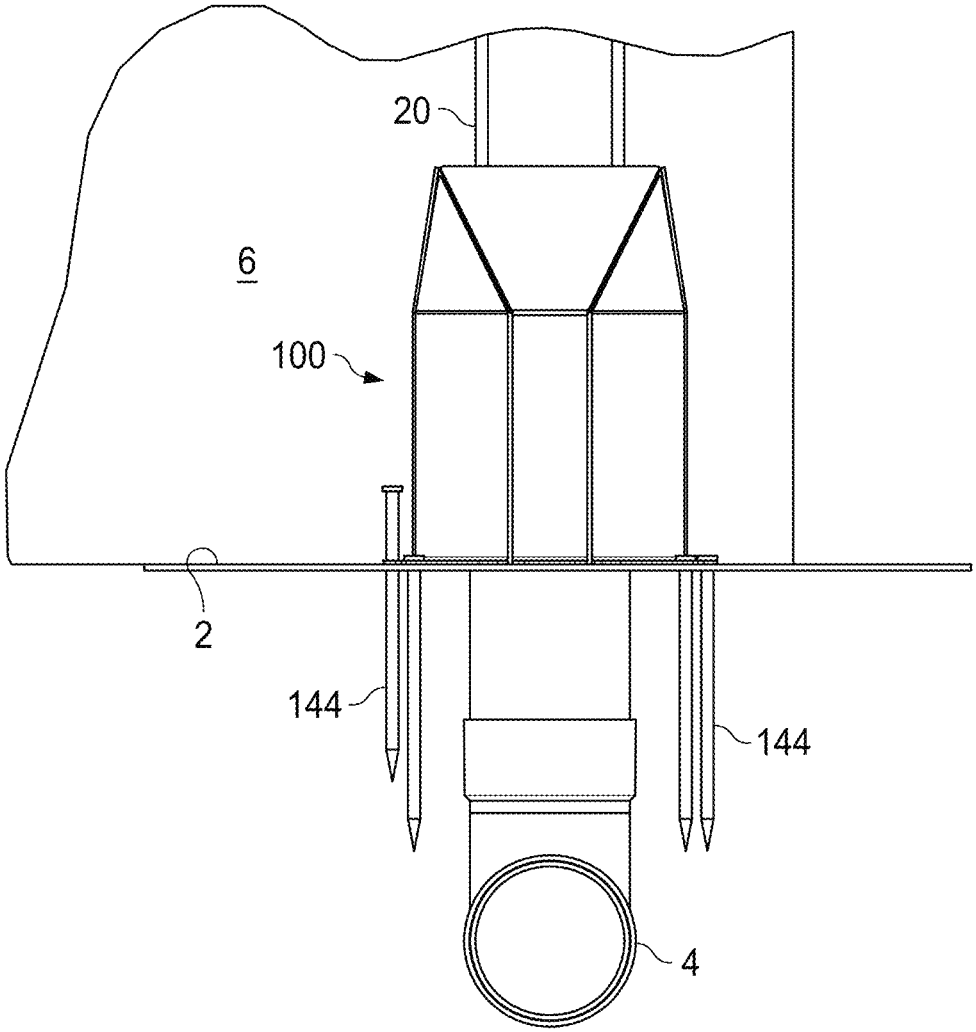
FIG. 14 is a front subsurface view of the embodiment of the drainage junction shield installation illustrated in FIGS. 12 and 13.

Flange right 132, flange right chamfer 134, flange front 136, flange left chamfer 138, and flange left 140, each have a plurality of anchor holes 142 for receiving soil pins 144 (see FIG. 14).

Figure 6:
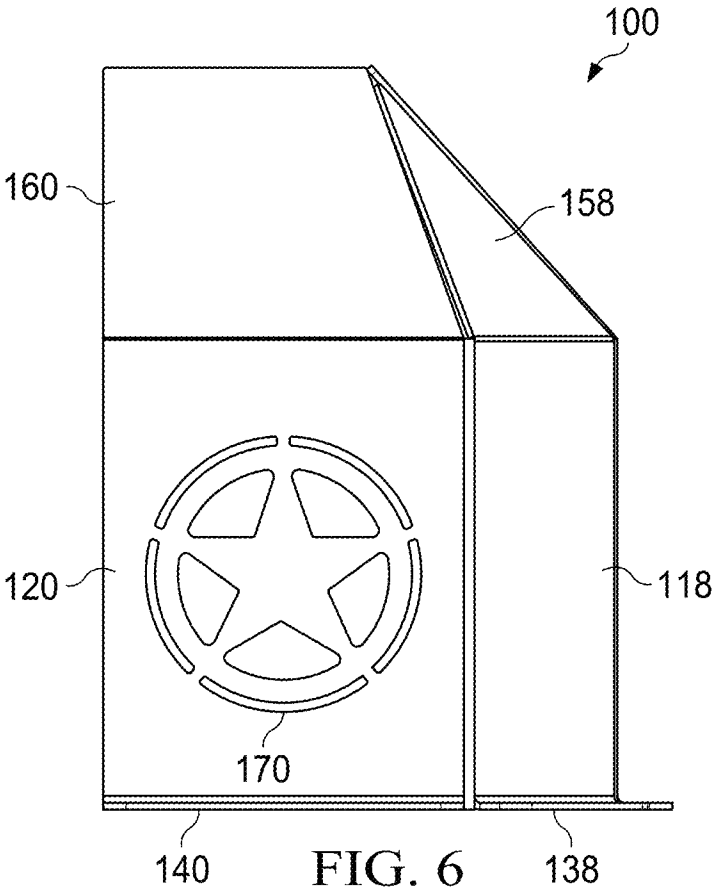
FIG. 6 is a left side view of the embodiment of the drainage junction shield of FIG. 5.

FIG. 6 is a left side view of the embodiment of the drainage junction shield 100 of FIG. 5. As seen in FIG. 6, extension left 160 extends above and is contiguous with base left 120. Extension left chamfer 158 extends above and is contiguous with base left chamfer 118. Base left 120 is contiguous with base left chamfer 118. In the embodiment illustrated, decorative element 170 is located on base left 120. Extension left 160 is located in alignment with extension left chamfer 158.

Figure 7:
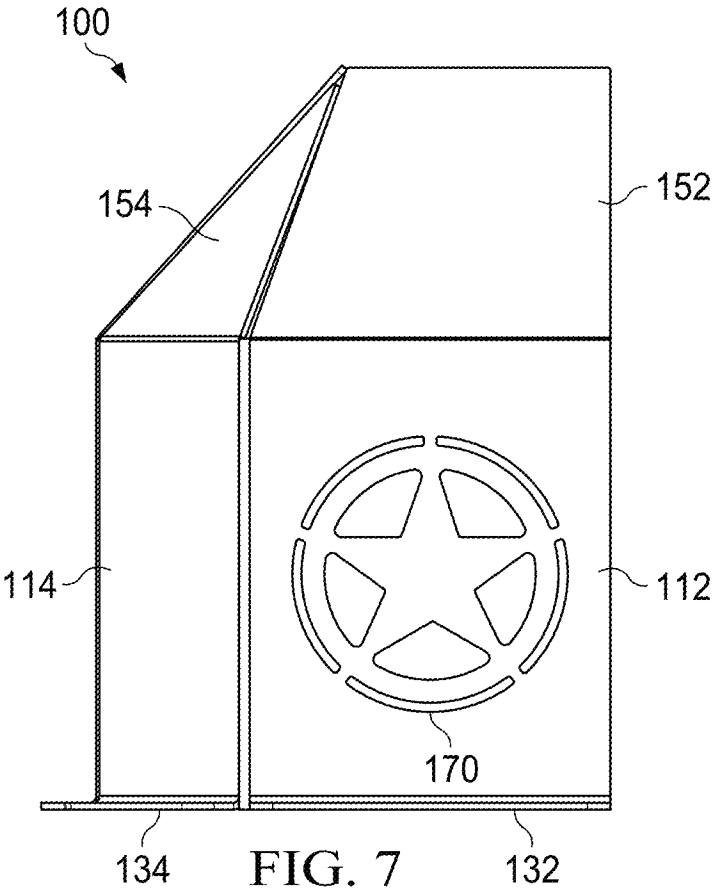
FIG. 7 is a right side view of the embodiment of the drainage junction shield of FIG. 5.

FIG. 7 is a right side view of the embodiment of the drainage junction shield 100 of FIG. 5. As seen in FIG. 7, extension right 152 extends above and is contiguous with base right 112. Extension right chamfer 154 extends above and is contiguous with base right chamfer 114. Base right 112 is contiguous with base right chamfer 114. In the embodiment illustrated, decorative element 170 is located on base right 112. Extension right 152 is located in alignment with extension right chamfer 154.

Figure 8:
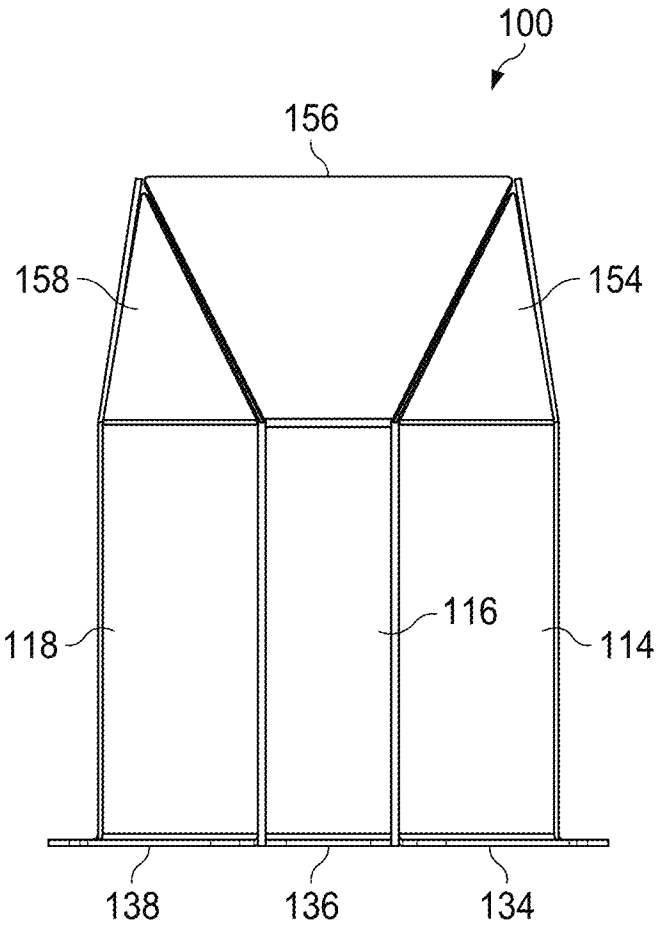
FIG. 8 is a front view of the embodiment of the drainage junction shield of FIG. 5.

FIG. 8 is a front view of the embodiment of the drainage junction shield 100 of FIG. 5. Base front 116 is contiguous with base left chamfer 118 and base right chamfer 114. Extension front 156 extends above and is contiguous with base front 116. In the embodiment illustrated, extension front 156 is located in adjacent alignment with extension left chamfer 158 and extension right chamfer 154.

Figure 9:
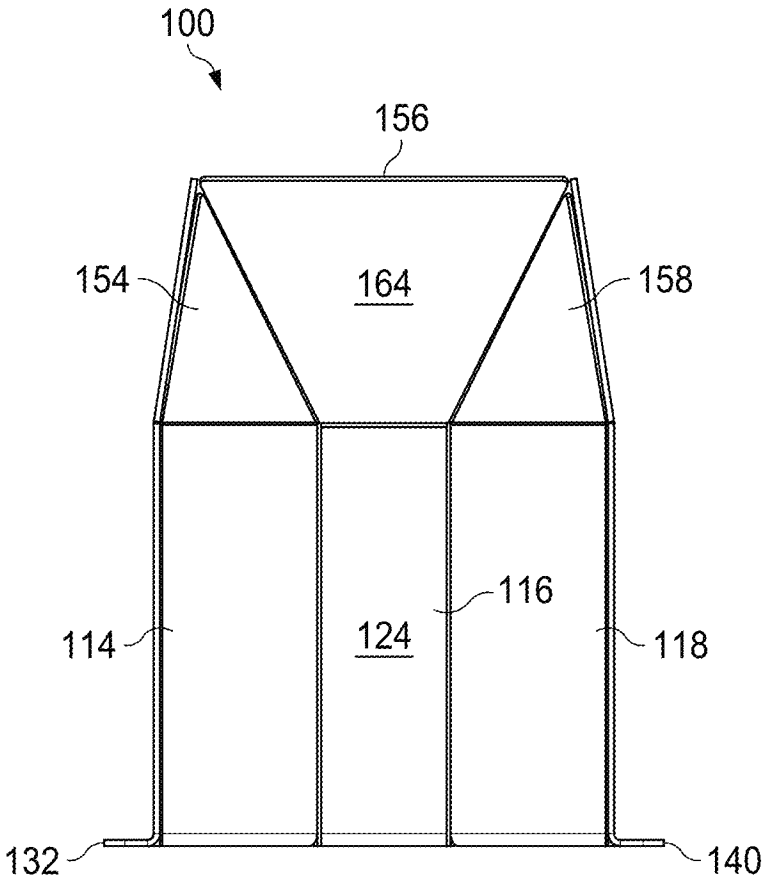
FIG. 9 is a rear view of the embodiment of the drainage junction shield of FIG. 5.

FIG. 9 is a rear view of the embodiment of the drainage junction shield 100 of FIG. 5. As seen in FIG. 9 and also FIG. 11, adapter chamber 124 is the volume within the confines of base 110. As also seen in FIG. 9, downspout chamber 164 is the volume within the confines of extension 150.

Figure 10:
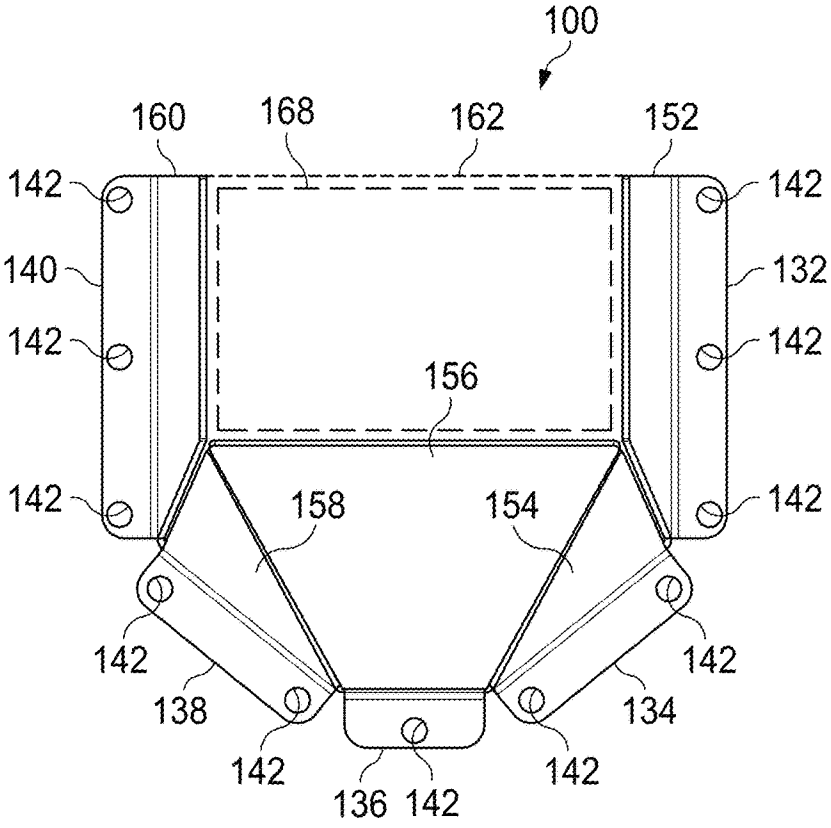
FIG. 10 is a top view of the embodiment of the drainage junction shield of FIG. 5.

FIG. 10 is a top view of the embodiment of the drainage junction shield 100 of FIG. 5. FIG. 10 illustrates entry perimeter 168 of downspout chamber 164. Entry perimeter 168 extends from extension right 152, to extension right chamfer 154, to extension front 156, to extension left chamfer 158, to extension left 160 and across extension access 162. Extension right 152, extension right chamfer 154, extension front 156, extension left chamfer 158, and extension left 160 are inclined inward to form a converging surface structure above and over downspout chamber 164.

FIG. 11 is a bottom view of the embodiment of the drainage junction shield of FIG. 5. FIG. 11 illustrates base perimeter 126 of adapter chamber 124. Base perimeter 126 extends from base right 112 to base right chamfer 114, to base front 116, to base left chamfer 118, to base left 120, and across base access 122.

Figure 12:
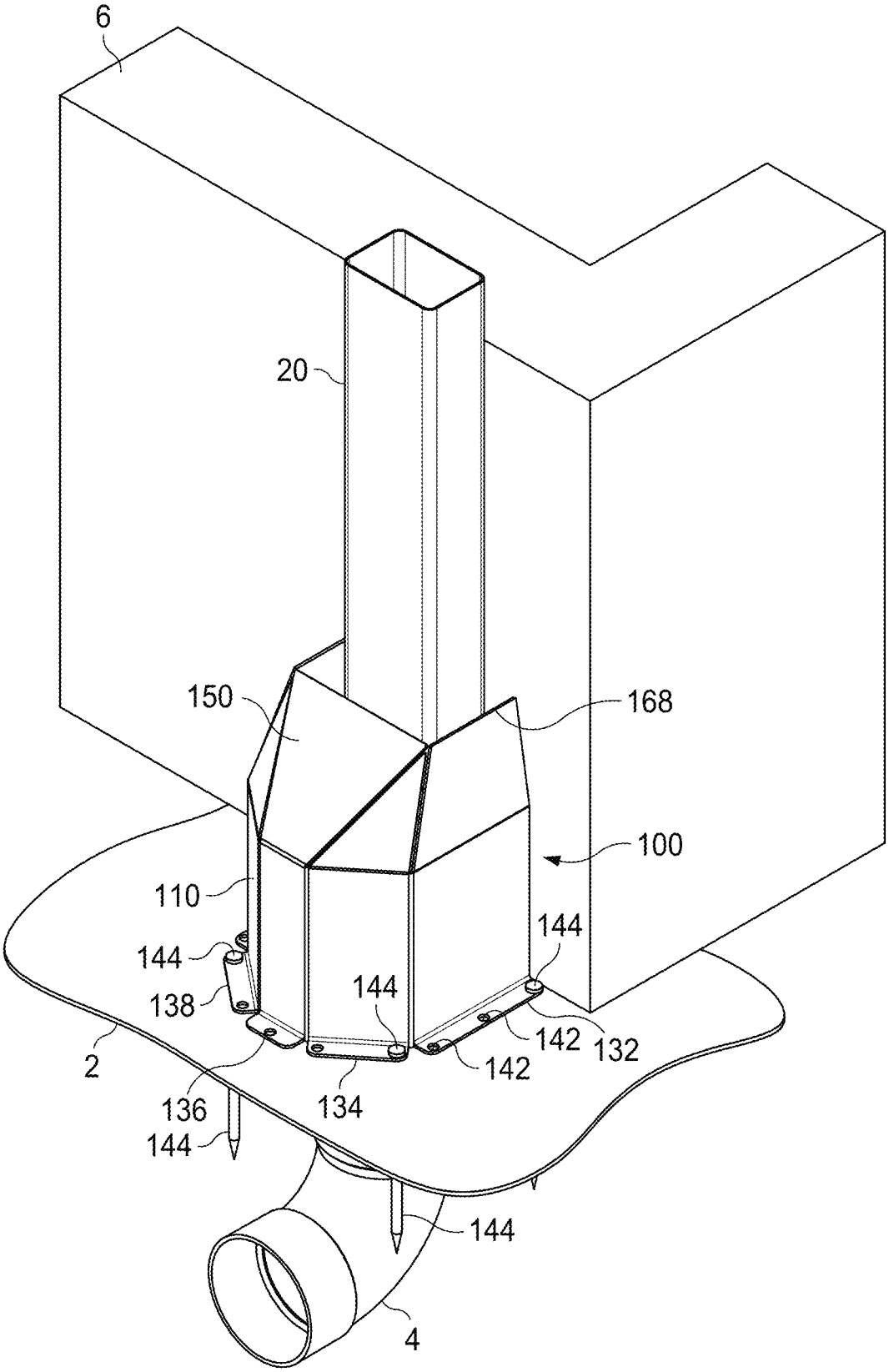
FIG. 12 is an isometric view of the embodiment of the drainage junction shield of FIG. 5, illustrated installed on a soil adjacent to a wall and protecting the intersection of a downspout, adapter, and drainpipe.

FIG. 12 is an isometric view of the embodiment of drainage junction shield 100, illustrated installed on a soil surface 2 adjacent to a wall 6 and protecting the intersection of downspout 20, adapter 10, and drainpipe 4. As seen in this view, downspout 20 passes through entry perimeter 168. Downspout 20, adapter junction 10, and drainpipe 4 are no longer visible and are protected from landscape machinery such as string trimmers and edgers. Wall 6 provides a plane of closure across base access 122 and extension access 162. Soil pins 144 extend through anchor holes 142 of a flange system 130 (see FIG. 10). As seen below soil surface 2, soil pins 144 are positioned to avoid contact with drainpipe 4.

Figure 13:
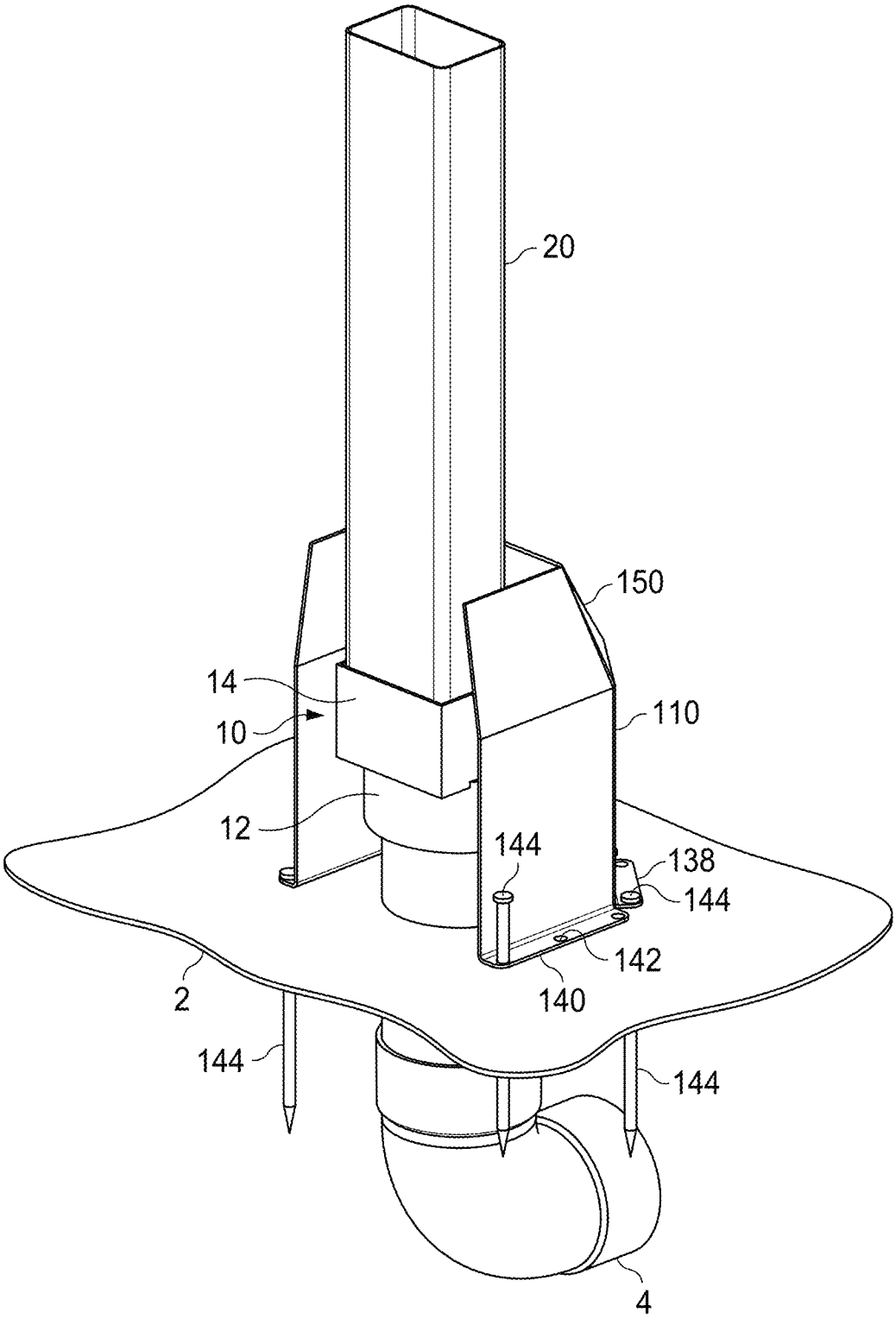
FIG. 13 is a rear isometric view of the embodiment of the drainage junction shield installation illustrated in FIG. 12 with the wall removed for visibility.

FIG. 13 is a rear isometric view of the embodiment illustrated in FIG. 12 with wall 6 removed for visibility. As seen from this view, downspout 20, adapter junction 10, and drainpipe 4 are no longer visible and are protected from landscape machinery such as string trimmers and edgers. In conventional stormwater assemblies, downspout 20 may be attached to wall 6 and transitions adapter 10, and drainpipe 4 will be located approximate to wall 6. Extension access 162 and base access 122 permit sliding engagement of drainage junction shield 100 into position before inserting soil pins 144 in anchor holes 142.

FIG. 14 is a front subsurface view of the embodiment of the drainage junction shield installation 100 illustrated in FIGS. 12 and 13. In FIG. 14, drainpipe 4 is oriented 180 degrees away from the wall. Soil pins 144 are inserted in anchor holes 142 located in flange right 132 and flange left 140 as to avoid conflict with drainpipe 4.

Figure 15:
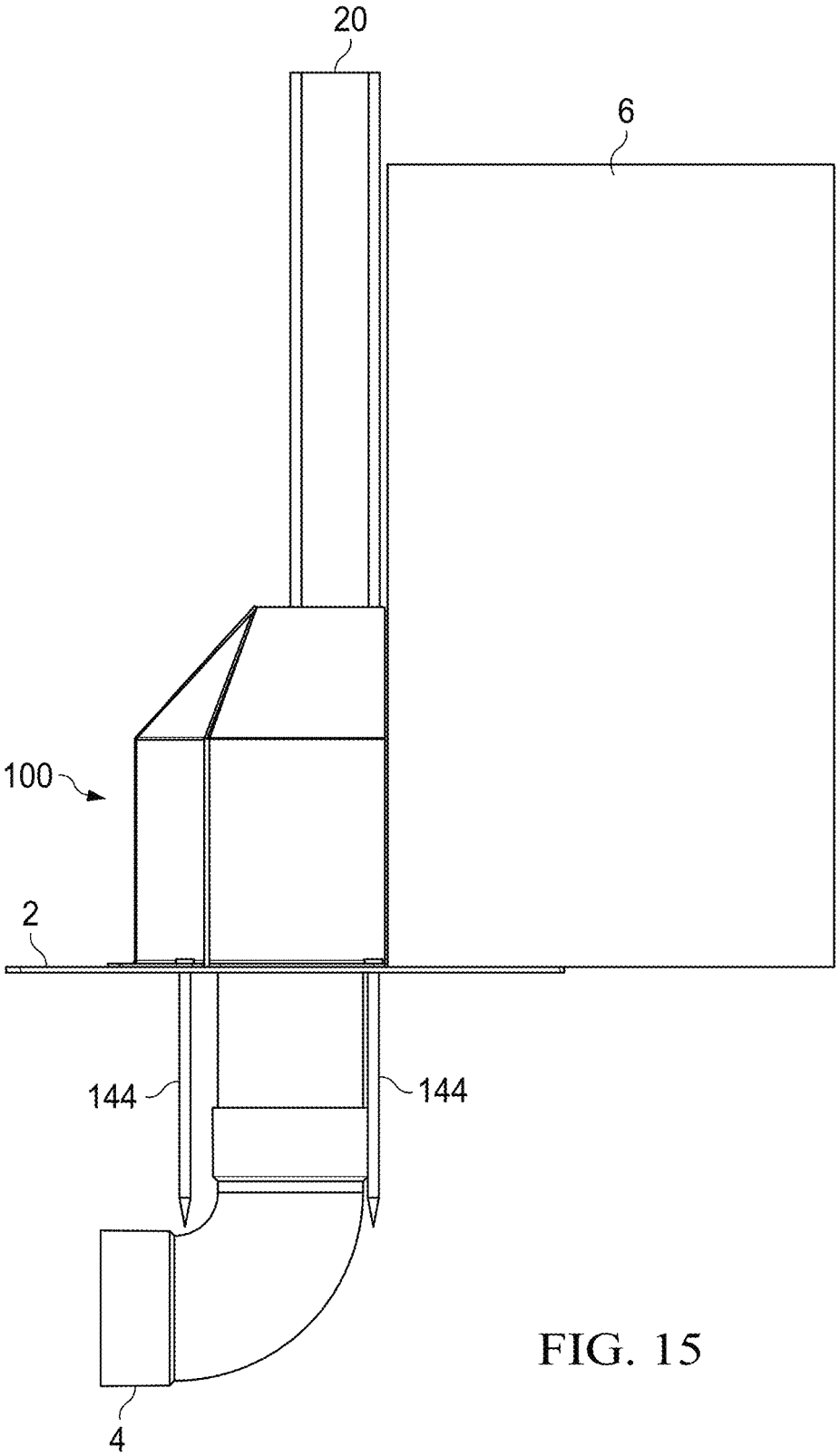
FIG. 15 is a side subsurface view of the embodiment of the drainage junction shield installation illustrated in FIG. 12.

FIG. 15 is a side subsurface view of the embodiment of the drainage junction shield installation 100 illustrated in FIG. 12, illustrating again the absence of conflict between soil pins 144 and drainpipe 4.

Figure 16:
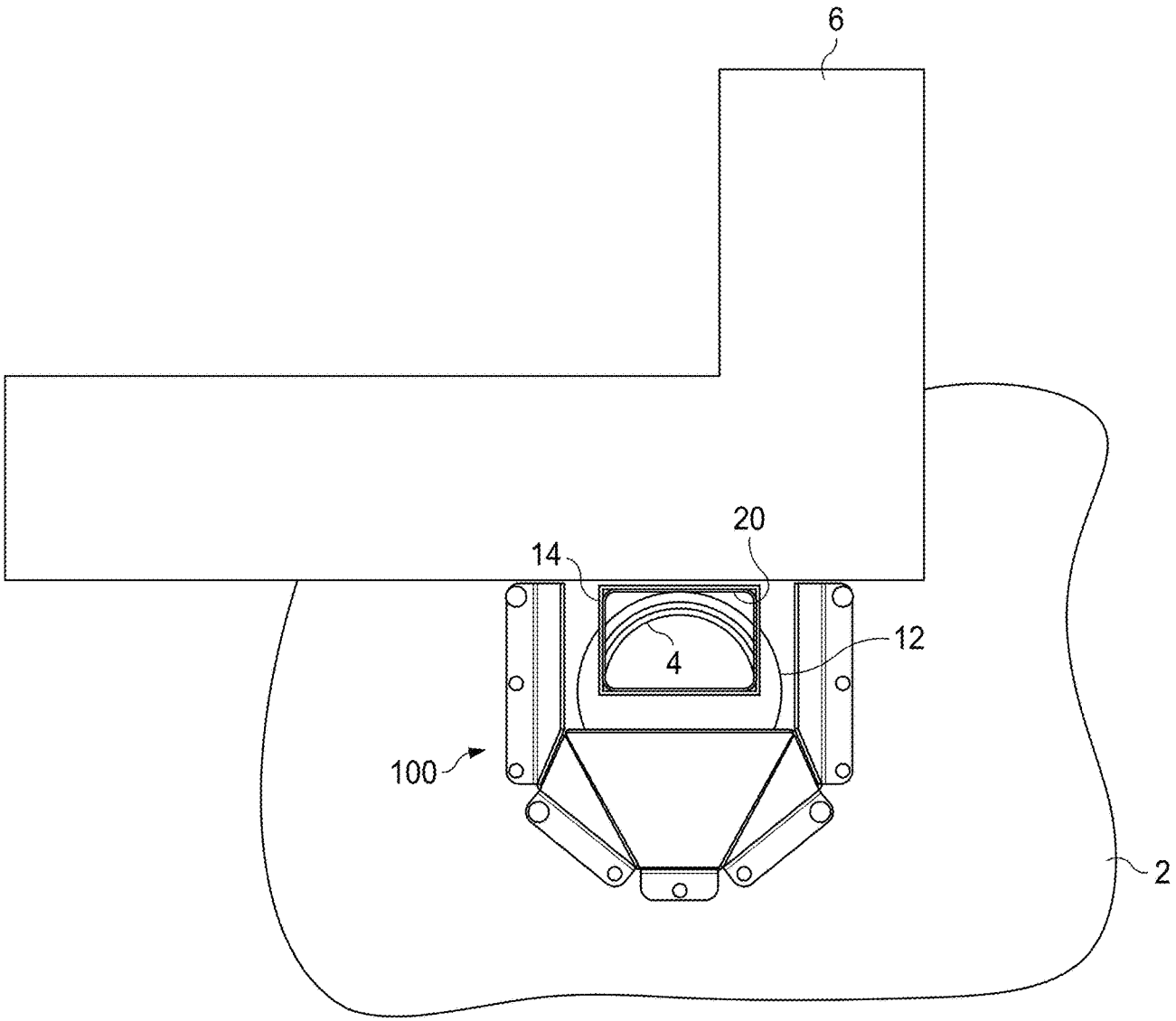
FIG. 16 is a top view of the embodiment of the drainage junction shield installation illustrated in FIG. 12.

FIG. 16 is a top view of the embodiment of the drainage junction shield installation 100 illustrated in FIG. 12. As seen in this view, adapter 10 and downspout 20 are shielded within adapter chamber 124 and downspout chamber 164 of drainage junction shield 100.

Figure 17:
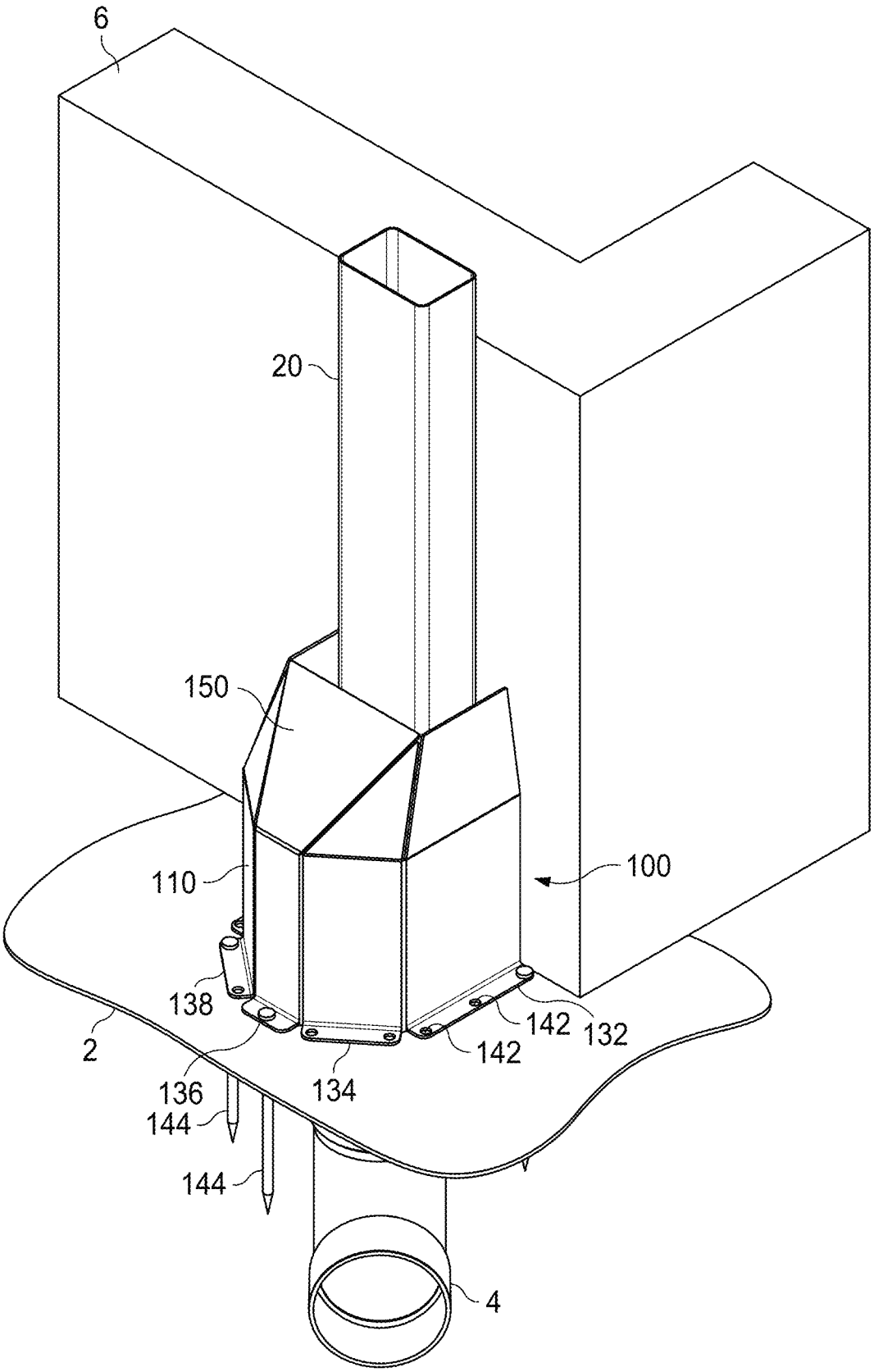
FIG. 17 is an isometric view of the embodiment of the drainage junction shield of FIG. 5, illustrated installed on a soil adjacent to a wall and protecting the intersection of a downspout, adapter, and drainpipe. In this view, the drainpipe is angled at approximately 45 degrees away from the wall.

FIG. 17 is an isometric view of the embodiment of the drainage junction shield 100 of FIG. 5, illustrated installed on soil surface 2 adjacent to wall 6 and protecting the intersection of downspout 20, adapter 10, and drainpipe 4. In this view, drainpipe 4 is angled at approximately 45 degrees away from wall 6. In this view, soil pins 144 are relocated to anchor holes 142 in alternative flanges such as flange left chamfer 138 and flange front 136 to secure drainage junction shield 100 to soil surface 2.

Figure 18:
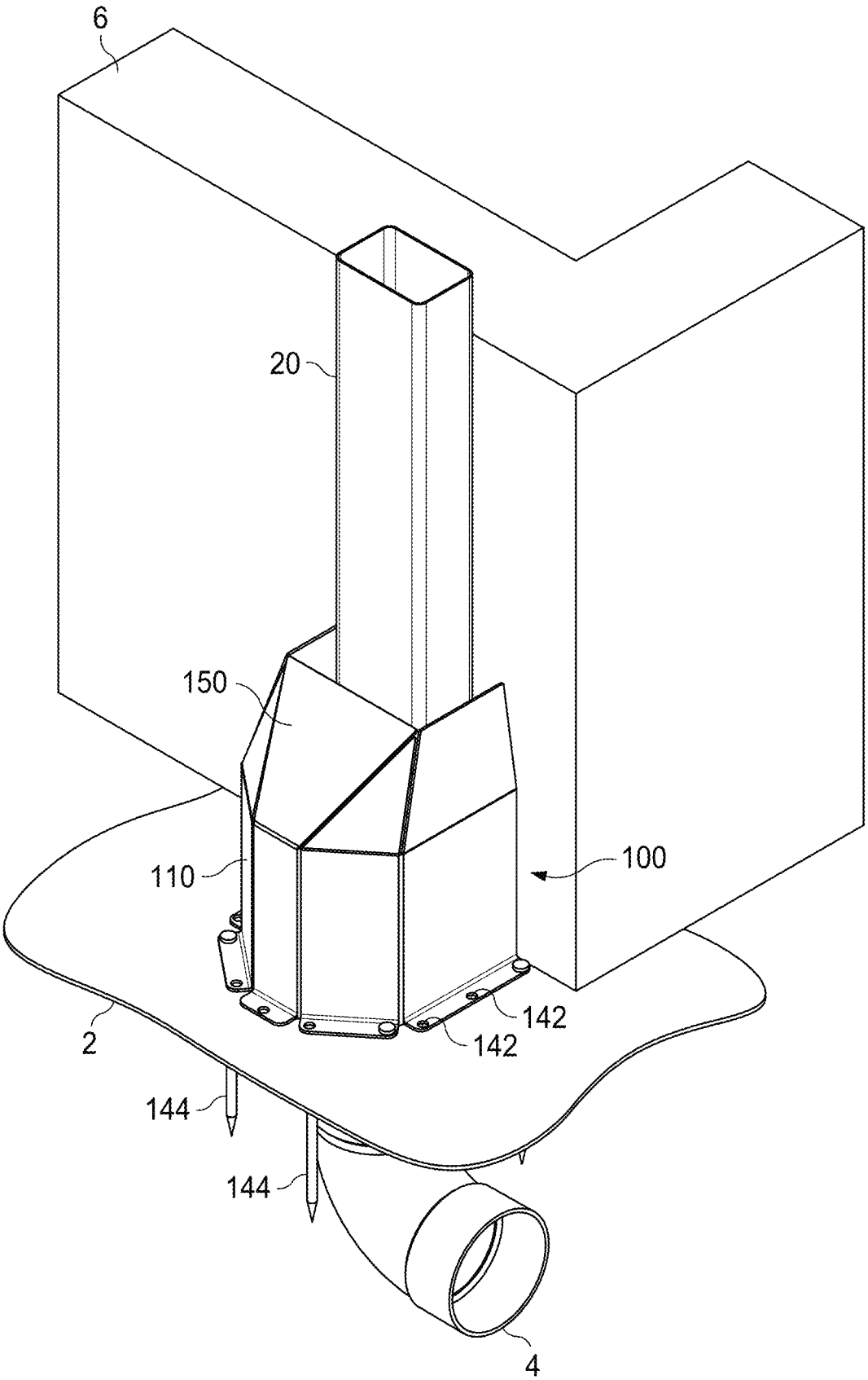
FIG. 18 is an isometric view of the embodiment of the drainage junction shield of FIG. 5, illustrated installed on a soil adjacent to a wall and protecting the intersection of a downspout, adapter, and drainpipe. In this view, the drainpipe is angled approximately parallel to the wall.

FIG. 18 is an isometric view of the embodiment of the drainage junction shield 100 of FIG. 5, illustrated installed on soil surface 2 adjacent to wall 6 and protecting the intersection of downspout 20, adapter 10, and drainpipe 4. In this view, drainpipe 4 is angled approximately parallel to wall 6. As with FIG. 17, in this configuration, soil pins 144 may be relocated to anchor holes in alternative flanges to secure drainage junction shield 100 to soil surface 2.

Figure 19:
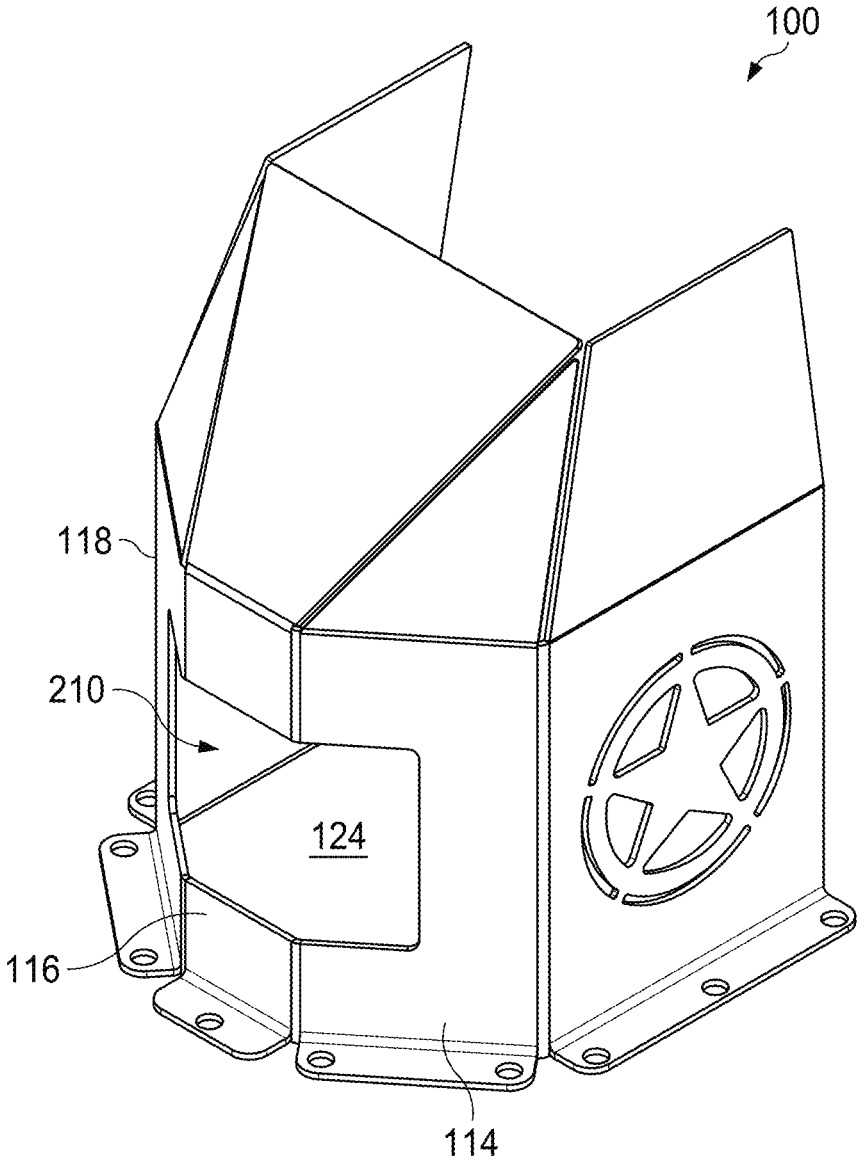
FIG. 19 is an isometric view of an alternative embodiment of the drainage junction shield, designed for compatibility with a downspout that does not connect to a drainpipe, but for redirection of storm water away from a foundation.

FIG. 19 is an isometric view of an alternative embodiment of the drainage junction shield 100, designed for compatibility with downspout 20 that does not connect to drainpipe 4, but is for redirection of storm water away from wall 6 onto soil surface 2. This permits compatibility of the aesthetic appearance of downspout 20 to drainpipe 4 connections in buildings where some downspouts 20 are connected to drainpipes 4 and others are not. In this embodiment, drainage junction shield 100 includes a drain portal 210 for accommodating a downspout drain 22.

Figure 20:
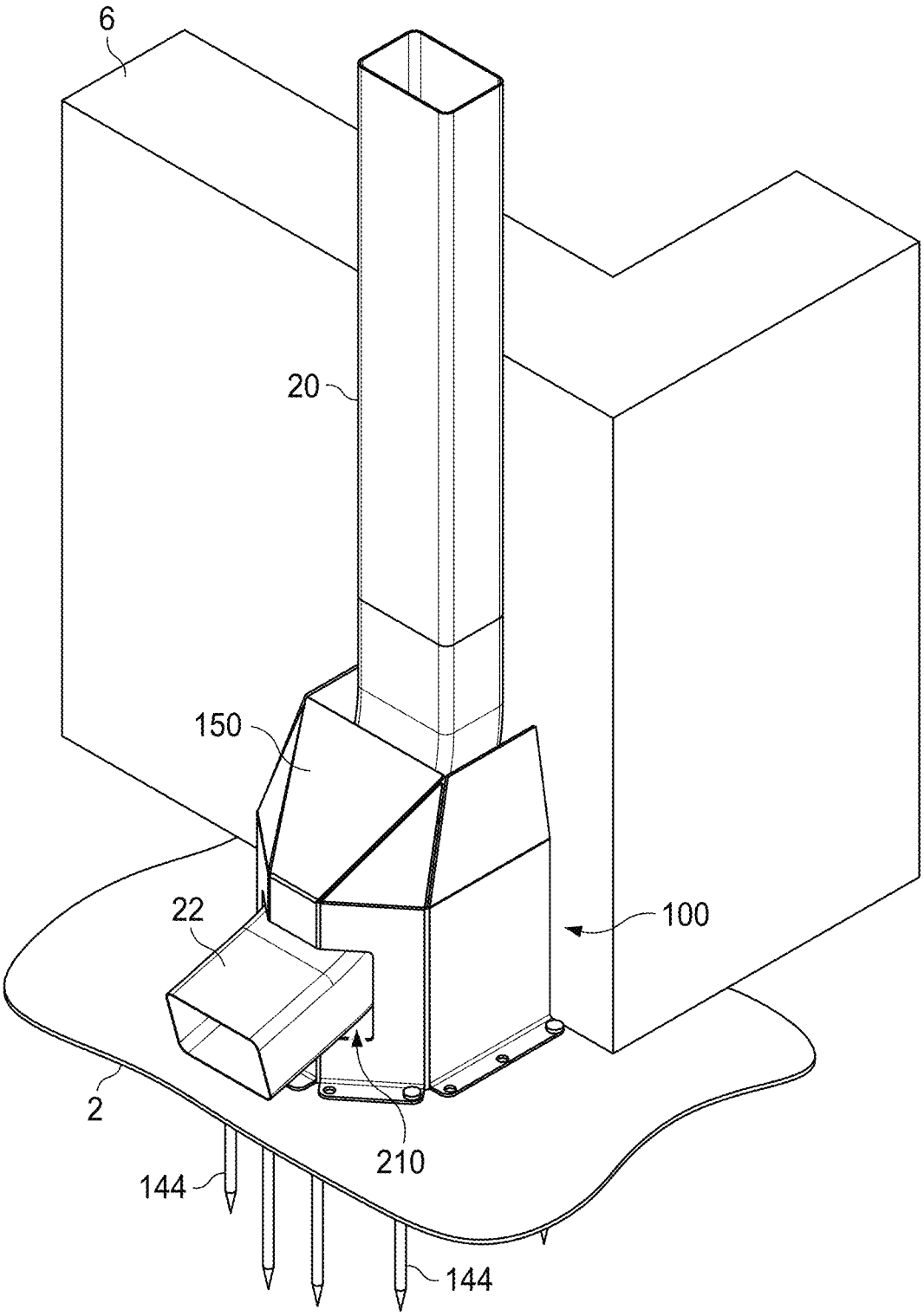
FIG. 20 is an isometric view of the embodiment of FIG. 19 illustrated installed on a soil adjacent to a wall and protecting the downspout.

FIG. 20 is an isometric view of the embodiment of FIG. 19 illustrated installed on soil surface 2 adjacent to wall 6 and protecting downspout 20. This embodiment illustrates the advantage of the cooperative configuration between base access 122, extension access 162 and downspout portal 210 in that drainage junction shield 100 may be slid into place against wall 6 without disruption of the assembly of downspout 20 and downspout drain 22.

Figure 21:
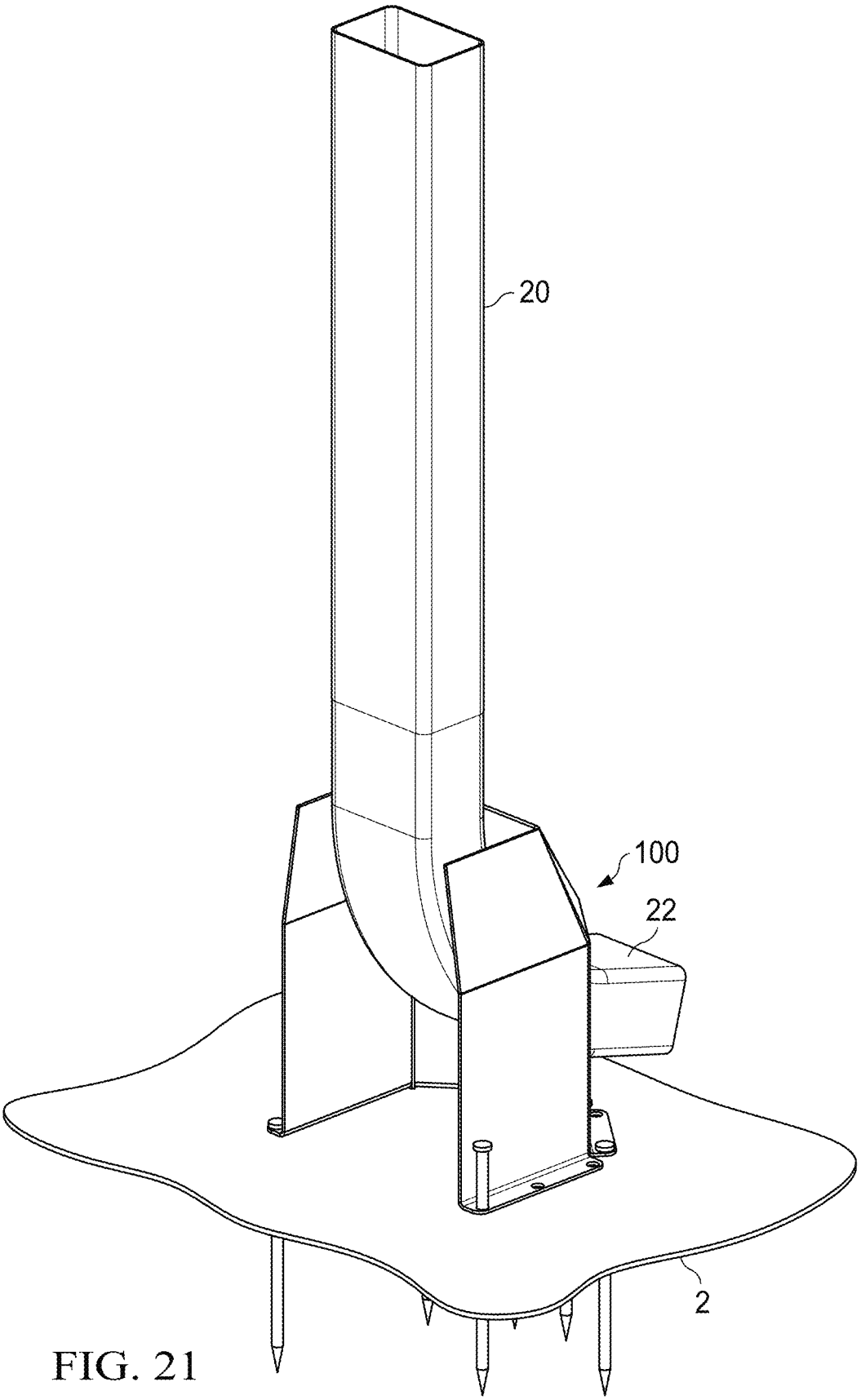
FIG. 21 is a rear isometric view of the embodiment illustrated in FIG. 20 with the wall removed for visibility.

FIG. 21 is a rear isometric view of the embodiment illustrated in FIG. 20 with wall 6 removed for visibility. As seen in this view, the embodiment continues to benefit from the arrangement of soil pins 144 through flange system 130 through anchor holes 142. This permits a similar appearance to this embodiment as to the embodiment in which downspout 20 is not connected to drainpipe 4. While access to anchor holes 142 under flange front 136 may be restricted by downspout drain 22, there are several alternative anchor holes 142 in flange system 130 accessible for securing drainage junction shield 100 to soil surface 2.

Figure 22:
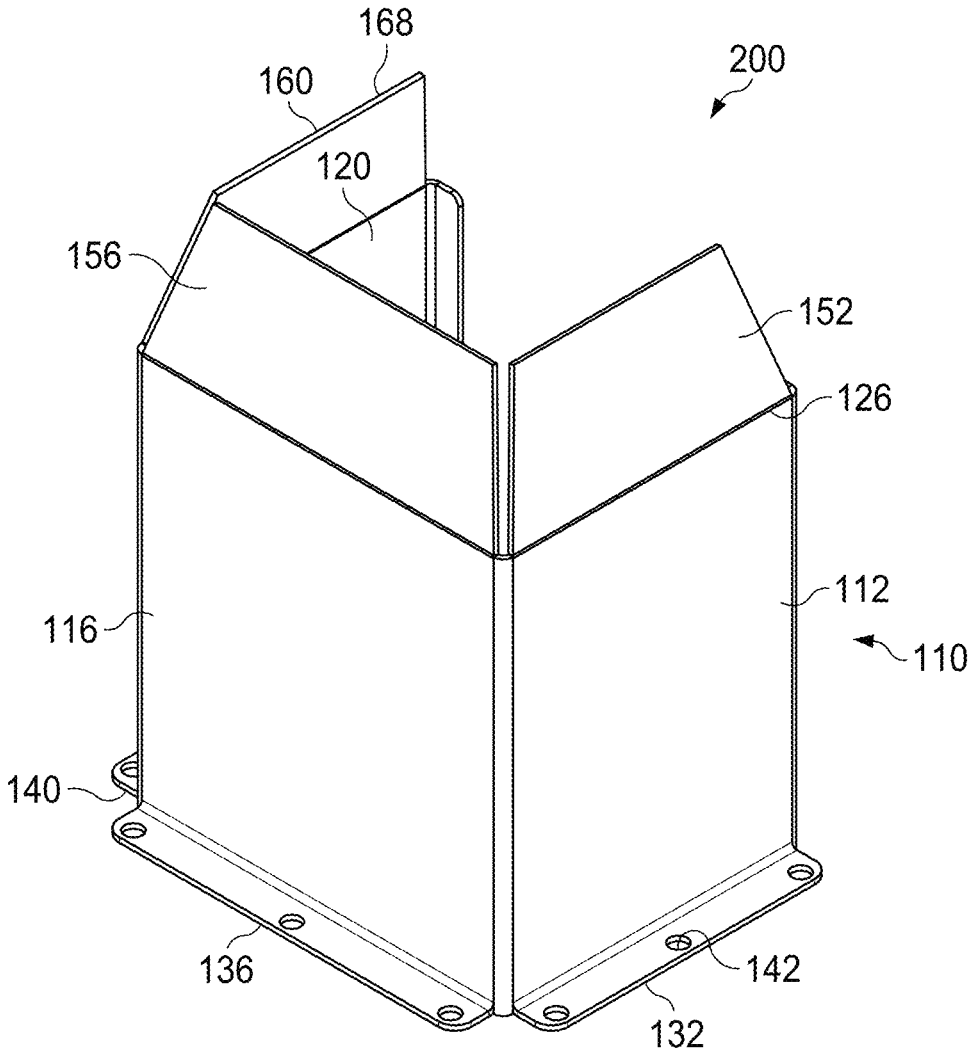
FIG. 22 is an isometric view of an alternative embodiment of the drainage junction shield in a simple three-sided rectilinear form.

FIG. 22 is an isometric view of an alternative embodiment for a drainage junction shield 200 having three sides. This embodiment lacks certain benefits of the embodiment of drainage junction shield 100 shown in FIG. 5, such as superior aesthetic value, ability to enclose the round geometry of a conventional drainpipe 4 in closer proximity, and ability to better deflect, without rupturing, rotating strings of a string trimmer. However, drainage junction shield 200 may be less expensive to manufacture, depending on the method used.

In this embodiment, base right 112 is contiguous with base front 116 and extension right 152. Similarly, base left 120 is contiguous with base front 116 and extension left 160. Extension front 156 is located in adjacent alignment with extension right 152 and extension left 160.

Extension right 152, extension front 156 and extension left 160 are inclined inwards to form rectangular entry perimeter 168 for receiving downspout 20. The convergence of base right 112, base front 116, and base left 120 with extension right 152, extension front 156 and extension left 160, defines rectangular base perimeter 126 that outlines adapter chamber 124, which is sufficiently large to receive adapter 10 and drainpipe 4. Base perimeter 126 is larger than entry perimeter 168.

Flanges 130 extend perpendicularly outward from base right 112, base front 116, and base left 120. Anchor holes 142 are provided on flanges 130 for receiving soil pins 144.

Figure 23:
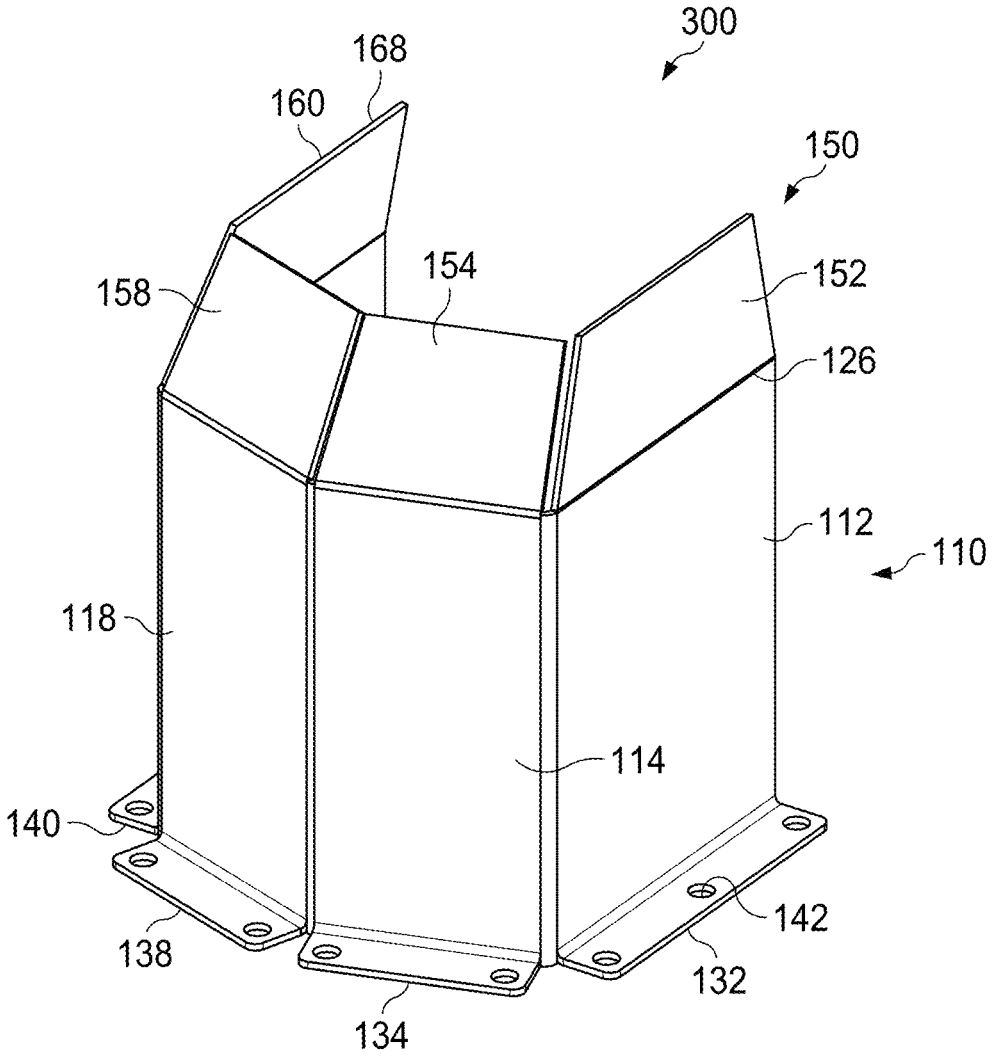
FIG. 23 is an isometric view of another alternative embodiment of the drainage junction shield in a four-sided form.

FIG. 23 is an isometric view of another alternative embodiment of the drainage junction shield 300 in a four-sided form. In each embodiment 100, 200, and 300, placement of drainage junction shield (100, 200, 300) against wall 6 creates a complete enclosure of adapter chamber 124 and downspout chamber 164. This occurs because wall 6 provides an additional side by covering base access 122 and extension access 162.

In drainage junction shield 300, base right 112 is contiguous with base right chamfer 114, base left chamfer 118, and base left 120. Base right 112 is contiguous with extension right 152. Base right chamfer 114 is contiguous with extension right chamfer 154. Base left chamfer 118 is contiguous with extension left chamfer 158. Base left 120 is contiguous with the extension left 160.

Extension right 152, extension right chamfer 154, extension left chamfer 158 and extension left 160 are inclined inwards to form rectangular entry perimeter 168 for receiving downspout 20. The convergence of base right 112, base right chamfer 114, base left chamfer 118, and base left 120 with extension right 152, extension right chamfer 154, extension left chamfer 158 and extension left 160, defines a pentagonal base perimeter 126 that outlines adapter chamber 124, which is sufficiently large to receive adapter 10 and drainpipe 4. Base perimeter 126 is larger than entry perimeter 168.

Flanges 130 extend perpendicularly outward from base right 112, base right chamfer 114, base left chamfer 118, and base left 120. Anchor holes 142 are provided on flanges 130 for receiving soil pins 144.

It is readily understandable that base right 112 and extension right 152 may be a unitary structure in this embodiment, along with base left 120 and extension left 160. Thus, with no bend between the base 110 and extension 150 elements. In that configuration, only base front 116 is inwardly inclined.

FIG. 24 is a bottom view of the embodiment of drainage junction shield 100 illustrated in FIG. 5, illustrating the various radial distances between anchor holes 142 and the proximate center of drainpipe 4. These distances were measured in one application of the embodiment and are provided in Table 1 below:

TABLE 1

| Line | Inches |
|---|---|
| 180 (x2) | 3.92 |
| 182 (x2) | 3.25 |
| 184 (x2) | 3.40 |
| 186 (x2) | 3.38 |
| 188 (x2) | 3.41 |
| 190 | 3.49 |

The data set of 11 points from Table 1 produces an average of 3.47, a standard deviation of 0.23 and the variance 0.05. This data set represents a close pattern of distances between a center point of drainpipe 4 and locations for placement soil pins 144. This advantageously provides even force resistance to displacement of drainage junction shield 100 in response to impact from string trimmers and other items associated with work and play in a landscape environment.

FIG. 25 is a bottom view of the embodiment of drainage junction shield 200 illustrated in FIG. 22, illustrating the various radial distances between anchor holes 142 and the proximate center of drainpipe 4. These distances were measured in one application of the embodiment and are provided in Table 2 below:

TABLE 2

| Line | Inches |
|---|---|
| 280 (x2) | 3.78 |
| 282 (x2) | 3.28 |
| 284 (x2) | 3.78 |
| 286 (x2) | 3.66 |
| 288 | 2.71 |

The data set of 9 points from Table 2 produces an average of 3.78, a standard deviation of 0.37 and the variance 0.14. This data set represents a less close and less even pattern of distances between a center point of drainpipe 4 and locations for placement soil pins 144. This pattern thus provides less even force resistance to displacement of drainage junction shield 200 in response to impact from string trimmers and other items associated with work and play in a landscape environment.

Figure 26:
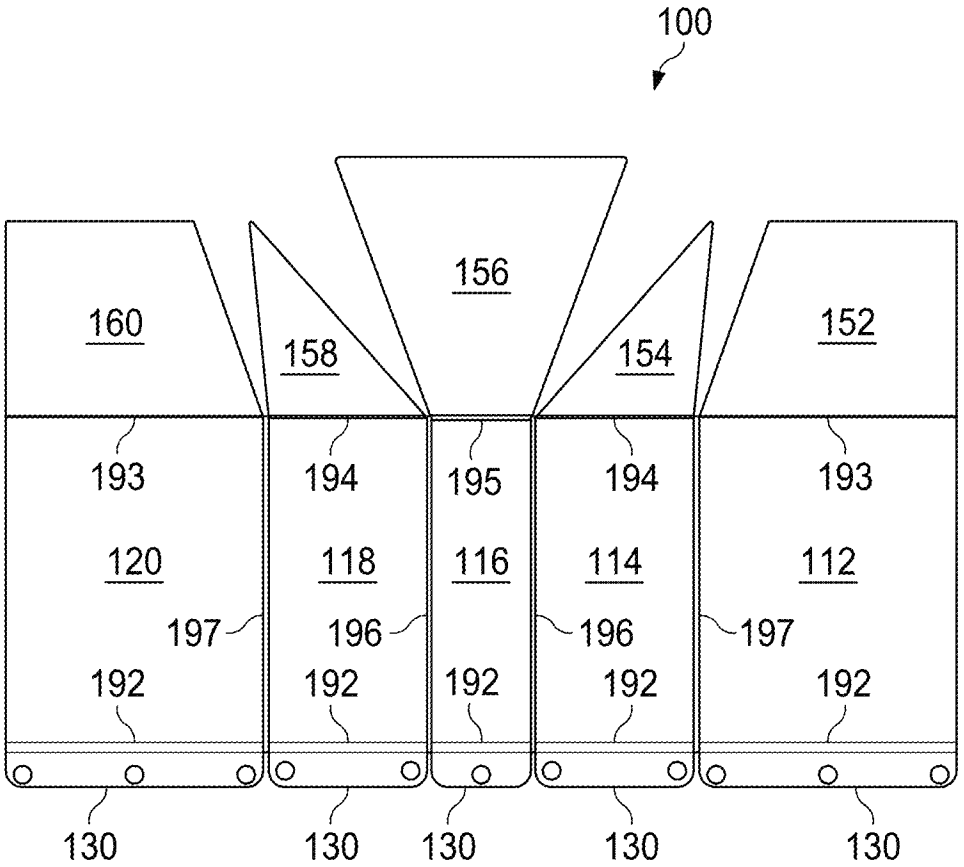
FIG. 26 illustrates a manufacturing pattern for punching and folding a drainage junction shield of the embodiment of FIG. 5.

FIG. 26 illustrates an embodiment for a method for manufacturing the 5-sided drainage junction shield 100 as illustrated in FIG. 5. In this method, a sheet metal template is provided by stamping or metal cutting process, and then folded to produce the 3-dimensional drainage junction shield 100. The metal template is preferably between 12 and 16 gauge steel. The method disclosed is advantageous because it does not require welding or fastening. The method comprises the steps of:

a) providing a flat sheet metal template for drainage junction shield 100 similar to the example illustrated in FIG. 26;
b) bend forming at 192 flanges 130 outward about 90 degrees to the template plane;
c) bend forming at 193 extension left chamfer 158 and extension right chamfer 114 inward between 6 and 10 degrees to the template plane;
d) bend forming at 194 extension left 160 and extension right 152 inward between 2 and 6 degrees to the template plane;
e) bend forming at 195 extension front 156 inward between 20 and 24 degrees to the template plane;
f) bend forming at 196 base left chamfer 118 and the base right chamfer 114 inward between 37 and 41 degrees to the template plane; and,
g) bend forming at 197 base left 120 and base right 112 inward between 85 and 90 degrees to the template plane.

Figure 27:
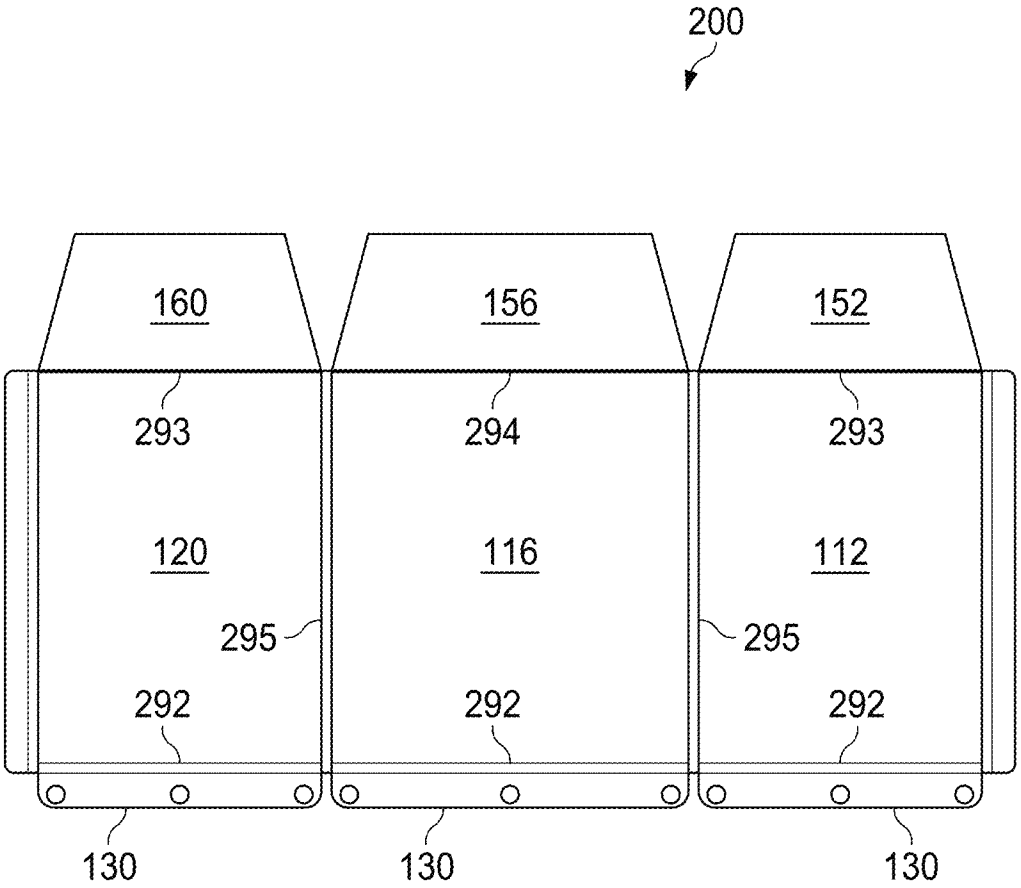
FIG. 27 illustrates a manufacturing pattern for punching and folding a drainage junction shield of the embodiment of FIG. 22.

FIG. 27 illustrates a manufacturing pattern for folding 3-sided drainage junction shield 200 as illustrated in FIG. 22. In this method, a sheet metal template is provided by stamping or metal cutting process, and then folded to produce the 3-dimensional drainage junction shield 200. The metal template is preferably between 12 and 16 gauge steel. The method disclosed is advantageous because it does not require welding or fastening. The method comprises the steps of:

a) providing a flat sheet metal template for drainage junction shield 200 similar to the example illustrated in FIG. 27;
b) bend forming at 292 flanges 130 outward about 90 degrees to the template plane;
c) (optionally) bend forming at 293 extension left 160 and extension right 152 inward between 0 and 20 degrees to the template plane;
d) bend forming at 294 extension front 156 inward between 5 and 40 degrees to the template plane; and,
e) bend forming at 295 base left 120 and base right 112 inward between 85 and 90 degrees to the template plane.

Figure 28:
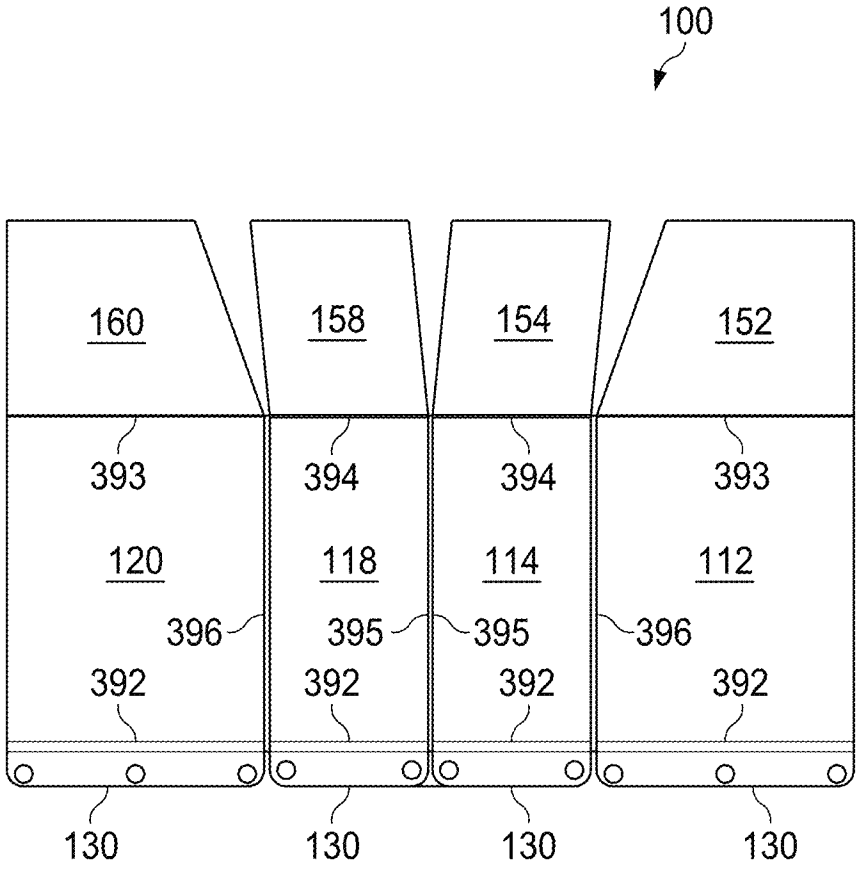
FIG. 28 illustrates a manufacturing pattern for punching and folding a drainage junction shield of the embodiment of FIG. 23.

FIG. 28 illustrates a manufacturing pattern for folding a 4-sided drainage junction shield 300 as illustrated in FIG. 23. In this method, a sheet metal template is provided by stamping or metal cutting process, and then folded to produce the 3-dimensional drainage junction shield 300. The metal template is preferably between 12 and 16 gauge steel. The method disclosed is advantageous because it does not require welding or fastening. The method comprises the steps of:

a) providing a flat sheet metal template for drainage junction shield 300 similar to the example illustrated in FIG. 28;
b) bend forming at 392 flanges 130 outward about 90 degrees to the template plane;
c) bend forming at 393 extension left 160 and extension right 152 inward between 0 and 15 degrees to the template plane;
d) bend forming at 394 extension left chamfer 158 and extension right chamfer 154 inward between 5 and 40 degrees to the template plane;
e) bend forming at 395 base left chamfer 118 and base right chamfer 114 inward between 5 and 30 degrees to the template plane; and,
f) bend forming at 396 base left 120 and base right 112 inward between 85 and 90 degrees to the template plane.

Drainage junction shields 100, 200, and 300 are impervious to deformation from engagement with a string trimmer, and thus protect the integrity of the connections between downspout 20, downspout adapter 10, and drainpipe 4.

While this invention has been described in connection with a limited number of embodiments, it is not intended to limit the scope of the disclosed device to the particular form set forth, but, on the contrary, is intended to cover such alternatives, modifications and equivalents as may be included within the spirit and scope of disclosed device as defined by the appended claims.

I claim:

1. A drainage junction shield, comprising:
a base comprising:
a base right;
a base front;
a base left; and,
a base access spanning between ends of the base left and the base right opposite to the base front;
an adapter chamber formed between the base left, base right, and base front;
an extension comprising:
an extension right extending above the base right;
an extension front extending above the base front;
an extension left extending above the base left; and,
an extension access spanning between ends of the extension left and the extension right opposite to the extension front;
a downspout chamber formed between the base left, base right, and base front;
a base perimeter formed at the intersection of the base and the extension;
an entry perimeter formed along the top of the extension opposite to the base perimeter;
the entry perimeter being shorter than the base perimeter; and,
wherein the drainage junction shield is impervious to deformation from engagement with a string trimmer.

2. The drainage junction shield of claim 1, further comprising:
the extension right inclined over the adapter chamber, towards the extension left;
the extension front inclined over the adapter chamber, towards the extension access; and,
the extension left inclined over the adapter chamber, towards the extension right.

3. The drainage junction shield of claim 1, further comprising:
a flange extending laterally outward from the base;
an anchor hole on the flange; and,
the anchor hole receivable of a soil pin for securing the drainage junction shield to a soil surface.

4. The drainage junction shield of claim 1, further comprising:
a flange extending laterally outward from each of the base left, base right, and base front;
a plurality of anchor holes on each flange; and,
the anchor holes receivable of a soil pin for securing the drainage junction shield to a soil surface.

5. The drainage junction shield of claim 4, further comprising:
wherein the number of the anchor holes exceeds the number of soil pins needed to secure the drainage junction shield to the soil; and,
wherein the locations of the anchor holes provide multiple non-conflicting locations for insertion of soil pins regardless of the direction of a drainpipe beneath the soil surface.

6. The drainage junction shield of claim 4, further comprising:
the anchor holes positioned within 80% of equidistant to a central point of the drainpipe position at the soil surface.

7. A method of manufacturing the drainage junction shield of claim 4, comprising the steps of:
providing a flat sheet metal template for the drainage junction shield, the template in a template plane;
bend forming the flanges outward about 90 degrees to the template plane;
bend forming the extension left and extension right inward between 0 and 20 degrees to the template plane;
bend forming the extension front inward between 5 and 40 degrees to the template plane;
and,
bend forming the base left and base right inward between 85 and 90 degrees to the template plane.

8. The drainage junction shield of claim 1, further comprising:
the adapter chamber being of sufficient volume to receive an adapter connected to a drainpipe and a downspout.

9. The drainage junction shield of claim 1, further comprising:
the base and adapter chamber being of sufficient height to receive an adapter connected to a drainpipe that extends partially above the soil surface.

10. The drainage junction shield of claim 1, further comprising:
the entry perimeter being of sufficient size to receive a gutter system downspout.

11. The drainage junction shield of claim 1, further comprising:
the entry perimeter sized to receive a gutter system downspout; and,
in sufficient proximity to limit foreign material entry into the downspout chamber.

12. The drainage junction shield of claim 1, further comprising:
the extension forming a converging enclosure above the base for complementary fit of a downspout into the entry perimeter.

13. The drainage junction shield of claim 1, further comprising:
the entry perimeter and extension access forming a polygon of fewer sides than the base perimeter and base access.

14. The drainage junction shield of claim 13, further comprising:
a flange extending laterally outward from each of the base left, base left chamfer, base right, base rate chamfer, and base front;
a plurality of anchor holes on each flange; and,
the anchor holes receivable of a soil pin for securing the drainage junction shield to a soil surface.

15. The drainage junction shield of claim 1, further comprising:
the base perimeter and base access forming a rectangle; and,
the entry perimeter and extension access forming a rectangle.

16. The drainage junction shield of claim 1, further comprising:
the base perimeter and base access forming a pentagon; and,
the entry perimeter and extension access forming a rectangle.

17. The drainage junction shield of claim 1, further comprising:
the base perimeter and base access forming a hexagon; and,
the entry perimeter and extension access forming a rectangle.

18. The drainage junction shield of claim 1, further comprising:
a decorative element positioned on the base.

19. The drainage junction shield of claim 1, further comprising:

a decorative element positioned on the extension.

20. The drainage junction shield of claim 1, further comprising:

the drainage junction shield made of 14 gauge steel.

21. The drainage junction shield of claim 1, further comprising:

a drain portal; and, wherein the drain portal is receivable of a drain spout of a downspout.

22. The drainage junction shield of claim 1, further comprising:

a base right chamfer between the base right and the base front;

a base left chamfer between the base left and the base front;

an extension right chamfer between the extension right and the extension front;

an extension left chamfer between the extension left and the extension front;

the base perimeter having five sides and forming a hexagon when placed adjacent a wall; and, the entry perimeter having three sides and forming a rectangle when placed adjacent the wall.

23. A drainage junction shield, comprising:

a base having four sections comprising:

a base right;

a base right chamfer;

a base left chamfer;

a base left; and, a base access spanning between ends of the base left and the base right opposite to the base front;

an adapter chamber formed inside the base right, base right chamfer, base left chamfer, and base right;

a flange extended from each of the base right, base right chamfer, base left chamfer, and base right;

an extension having four sections comprising:

an extension right extending above the base right;

an extension right chamfer extending above the base right chamfer;

an extension left chamfer extending above the base left chamfer;

an extension left extending above the base left; and, an extension access spanning between ends of the extension left and the extension right opposite to the extension front;

a downspout chamber formed between the base right, base right chamfer, base left chamfer, and base right;

a base perimeter formed at the intersection of the base and the extension;

an entry perimeter formed along a top of the extension opposite to the base perimeter;

the entry perimeter being shorter than the base perimeter; and, wherein the drainage junction shield is impervious to deformation from engagement with a string trimmer.

24. A method of manufacturing the drainage junction shield of claim 23, comprising the steps of:

providing a flat sheet metal template for the drainage junction shield, the template in a template plane;

bend forming the flanges outward about 90 degrees to the template plane;

bend forming the extension left and extension right inward between 0 and 15 degrees to the template plane;

bend forming the extension left chamfer and extension right chamfer inward between 5 and 40 degrees to the template plane;

bend forming the base left chamfer and the base right chamfer inward between 5 and 30 degrees to the template plane; and, bend forming the base left and base right inward between 85 and 90 degrees to the template plane.

25. A drainage junction shield, comprising:

a base having five sections comprising:

a base right;

a base right chamfer;

a base front;

a base left chamfer;

a base left; and, a base access spanning between ends of the base left and the base right opposite to the base front;

an adapter chamber formed between the base right, base left, and base front;

a flange extended from each of base section;

an extension having five sections comprising:

an extension right extending above the base right;

an extension right chamfer extending above the base right chamfer;

an extension front extending above the base front;

an extension left chamfer extending above the base left chamfer;

an extension left extending above the base left; and, an extension access spanning between ends of the extension left and the extension right opposite to the extension front;

a downspout chamber formed between the base left, base right, and base front;

a base perimeter formed at the intersection of the base and the extension;

an entry perimeter formed along a top of the extension opposite to the base perimeter;

the entry perimeter being shorter than the base perimeter; and, wherein the drainage junction shield is impervious to deformation from engagement with a string trimmer.

26. A method of manufacturing the drainage junction shield of claim 25, comprising the steps of:

providing a flat sheet metal template for the drainage junction shield, the template in a template plane;

bend forming the flanges outward about 90 degrees to the template plane;

bend forming the extension left chamfer and extension right chamfer inward between 5 and 40 degrees to the template plane;

bend forming the extension left and extension right inward between 2 and 6 degrees to the template plane;

bend forming the extension front inward between 20 and 24 degrees to the template plane;

bend forming the base left chamfer and the base right chamfer inward between 37 and 41 degrees to the template plane; and, bend forming the base left and base right inward between 85 and 90 degrees to the template plane.

27. A drainage junction shield, comprising:

a base;

a base access;

an adapter chamber formed within the base and base access;

a flange extending outward from the base;

a plurality of anchor holes located on the flange;

an extension located above the base;

an extension access in the same plane as the base access;

a downspout chamber formed within the extension and the extension access; and, an entry perimeter formed at a top of the extension;

wherein the base access and extension access allow adjacent placement of the drainage junction shield over a downspout and adapter, and against a vertical wall or structure;

wherein the entry perimeter is receivable of the downspout; and, wherein the anchor holes are receivable of soil pins for attachment of the drainage junction shield to a soil surface.

* * * * *